US011041696B2

(12) United States Patent
Swan et al.

(10) Patent No.: US 11,041,696 B2
(45) **Date of Patent: *Jun. 22, 2021**

(54) LOAD BEARING HARNESS

(71) Applicant: S&S Precision, LLC, Virginia Beach, VA (US)

(72) Inventors: Johnny E. Swan, Virginia Beach, VA (US); Andrew C. Borland, Virginia Beach, VA (US); William-Joseph Basan Elizalde, Virginia Beach, VA (US); Willem J. Van Reesema, Virginia Beach, VA (US)

(73) Assignee: S&S Precision, LLC, Virginia Beach, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/051,880

(22) Filed: Aug. 1, 2018

(65) Prior Publication Data

US 2019/0041167 A1 Feb. 7, 2019

Related U.S. Application Data

(60) Provisional application No. 62/539,809, filed on Aug. 1, 2017.

(51) Int. Cl.
*F41H 1/02* (2006.01)
*A45F 3/06* (2006.01)
(Continued)

(52) U.S. Cl.
CPC ..... *F41H 5/013* (2013.01); *A41D 1/04* (2013.01); *A41D 13/0518* (2013.01);
(Continued)

(58) Field of Classification Search
CPC .... F41H 1/02; F41H 5/013; A45F 3/06; A45F 3/047; A41F 9/02; A41F 9/025; A41D 13/0518
See application file for complete search history.

(56) References Cited

U.S. PATENT DOCUMENTS 1,619,452 A * 3/1927 Whitehill ..... A41F 3/045 267/69
3,114,486 A 12/1963 Flexman
(Continued)

OTHER PUBLICATIONS

Extended Search Report, EP 14 84 7651, dated Apr. 24, 2017.
International Search Report and Written Opinion, PCT/US2018/044772, dated Dec. 13, 2018.

*Primary Examiner* — Justin M Larson
(74) *Attorney, Agent, or Firm* — Tanner IP, PLLC

(57) ABSTRACT

Load carriage systems are described including one or more of a first chest panel, a first back panel, and a self-adjusting cummerbund connecting the first chest panel and the first back panel. The self-adjusting cummerbund may include a tensioning mechanism configured to allow the cummerbund to extend and retract, and may be configured to provide varying resistive force. The tensioning mechanism may include one or more of a sliding portion, a continuous patterned length of material that is folded over itself, and an elastic member that is attached to the sliding member and the length of material. Body armor plates may be held between outer and inner chest panels and/or between outer and inner back panels. A strip of webbing may be used to secure the body armor plate between the outer and inner panels.

20 Claims, 22 Drawing Sheets

(51) Int. Cl.

| | |
|---|---|
| ***F41H 5/013*** | (2006.01) |
| ***A41D 1/04*** | (2006.01) |
| ***A44B 11/06*** | (2006.01) |
| ***A41D 13/05*** | (2006.01) |
| ***A45F 3/14*** | (2006.01) |
| *F41H 5/04* | (2006.01) |
| *F41C 33/04* | (2006.01) |
| *A45F 3/04* | (2006.01) |
| *A45F 5/02* | (2006.01) |

(52) U.S. Cl.

CPC ..... *A44B 11/06* (2013.01); *A45F 3/06* (2013.01); *A45F 3/14* (2013.01); *F41H 1/02* (2013.01); *A41D 2400/48* (2013.01); *A41D 2500/52* (2013.01); *A45F 3/047* (2013.01); *A45F 5/02* (2013.01); *A45F 2003/146* (2013.01); *F41C 33/041* (2013.01); *F41C 33/046* (2013.01); *F41H 5/0435* (2013.01)

(56) References Cited

U.S. PATENT DOCUMENTS

| | | | | |
|---|---|---|---|---|
| 4,673,070 | A | 6/1987 | Kmbal | |
| 4,934,573 | A | 6/1990 | Jaeger | |
| 5,516,234 | A * | 5/1996 | Duchesne | B63C 11/08 2/102 |
| 5,664,292 | A | 9/1997 | Chen | |
| 5,724,707 | A | 3/1998 | Kirk et al. | |
| 5,815,843 | A | 10/1998 | Brillhart, III et al. | |
| 5,996,115 | A * | 12/1999 | Mazelsky | F41H 1/02 2/2.5 |
| 7,020,897 | B2 * | 4/2006 | Johnson | F41H 1/02 2/102 |
| 7,025,238 | B2 | 4/2006 | Hughes et al. | |
| 7,458,491 | B2 | 12/2008 | Cragg | |
| D588,801 | S | 3/2009 | Cicione | |
| 7,526,842 | B2 | 5/2009 | Wemmer | |
| 7,780,048 | B2 | 8/2010 | Howell | |
| 8,011,544 | B1 | 9/2011 | Howell | |
| 8,011,545 | B2 | 9/2011 | Murdoch et al. | |
| 8,079,503 | B1 | 12/2011 | Yeates et al. | |
| 8,132,699 | B2 * | 3/2012 | Hess | A45F 3/12 224/264 |
| 8,240,532 | B2 | 8/2012 | Cragg | |
| 8,322,065 | B2 | 12/2012 | Faifer | |
| D677,433 | S | 3/2013 | Swan et al. | |
| 8,485,405 | B2 | 7/2013 | Crye | |
| 8,713,764 | B1 | 5/2014 | Rittenhouse et al. | |
| 8,776,291 | B1 | 7/2014 | Lewis | |
| 8,826,462 | B2 * | 9/2014 | Storms, Jr. | F41H 1/02 2/2.5 |
| 9,049,917 | B2 * | 6/2015 | Shereyk | A45F 3/04 |
| 9,055,773 | B2 | 6/2015 | Crye | |
| 9,192,221 | B2 * | 11/2015 | Just | A45F 3/047 |
| 9,222,757 | B2 * | 12/2015 | Seuk | F41H 1/02 |
| 9,354,023 | B1 * | 5/2016 | Rittenhouse, Jr. | F41H 1/02 |
| D767,824 | S * | 9/2016 | Hilliard | D29/100 |
| 9,441,916 | B2 * | 9/2016 | Seuk | F41H 1/02 |
| 9,549,584 | B2 * | 1/2017 | Webster | A42C 5/02 |
| 9,651,339 | B2 * | 5/2017 | Storms, Jr. | A41D 1/04 |
| 9,723,909 | B2 * | 8/2017 | Alcantra | A41B 1/08 |
| 9,737,100 | B2 * | 8/2017 | McIntire, Jr. | F41H 1/02 |
| 9,752,854 | B1 * | 9/2017 | Rittenhouse, Jr. | A41D 31/245 |
| 9,777,997 | B2 * | 10/2017 | Swan | A41D 13/0518 |
| 9,801,458 | B2 * | 10/2017 | Storms, Jr. | A45F 5/02 |
| 9,839,279 | B2 * | 12/2017 | Seuk | A45F 3/14 |
| 9,970,736 | B2 * | 5/2018 | Beck | A41D 13/0575 |
| 9,993,039 | B2 * | 6/2018 | Nykoluk | A41D 13/0562 |
| 9,995,431 | B2 * | 6/2018 | Swan | F16M 13/04 |
| 10,060,707 | B2 * | 8/2018 | Searle | F41H 1/02 |
| 10,070,714 | B2 * | 9/2018 | Alcantra | A45F 5/02 |
| 10,145,507 | B2 * | 12/2018 | Swan | F41H 5/013 |
| 10,314,355 | B1 * | 6/2019 | Gallo | A41F 1/00 |
| D854,251 | S * | 7/2019 | Swan | D29/101.4 |
| 10,584,942 | B2 * | 3/2020 | Wellman | A41D 13/0568 |
| 10,605,574 | B2 * | 3/2020 | Swan | F41H 1/02 |
| 2001/0025867 | A1 | 10/2001 | Chuang | |
| 2005/0005343 | A1 | 1/2005 | Johnson | |
| 2005/0015944 | A1 | 1/2005 | Bergeron | |
| 2006/0242877 | A1 | 11/2006 | Clifton et al. | |
| 2007/0158380 | A1 | 7/2007 | Calkin | |
| 2008/0105722 | A1 | 5/2008 | Howell | |
| 2008/0257922 | A1 | 10/2008 | Cragg | |
| 2008/0277436 | A1 | 11/2008 | Wilson | |
| 2009/0277936 | A1 | 11/2009 | Rogers et al. | |
| 2009/0307878 | A1 | 12/2009 | Kadas | |
| 2010/0176174 | A1 | 7/2010 | Felts | |
| 2011/0107645 | A1 | 5/2011 | Faifer | |
| 2011/0132780 | A1 | 6/2011 | Marconi | |
| 2011/0191933 | A1 | 8/2011 | Gregory et al. | |
| 2012/0084906 | A1 | 4/2012 | Sego, Jr. et al. | |
| 2012/0132065 | A1 | 5/2012 | Seuk | |
| 2012/0132066 | A1 * | 5/2012 | Seuk | F41H 1/02 89/36.05 |
| 2012/0175391 | A1 | 7/2012 | Rogers et al. | |
| 2012/0180178 | A1 * | 7/2012 | Gallo | F41H 1/02 2/2.5 |
| 2012/0185988 | A1 * | 7/2012 | Herbener | F41H 1/02 2/2.5 |
| 2012/0311911 | A1 | 12/2012 | Nelson | |
| 2013/0042376 | A1 * | 2/2013 | Hexels | A45F 3/10 2/2.5 |
| 2013/0084764 | A1 | 4/2013 | Swan et al. | |
| 2013/0126566 | A1 | 5/2013 | Seuk et al. | |
| 2013/0181019 | A1 | 7/2013 | Salentine et al. | |
| 2013/0206806 | A1 | 8/2013 | Hu et al. | |
| 2014/0027480 | A1 | 1/2014 | Heusen | |
| 2014/0259251 | A1 | 9/2014 | Moore et al. | |
| 2014/0262892 | A1 | 9/2014 | Orozco et al. | |
| 2015/0090750 | A1 | 4/2015 | Coleman | |
| 2015/0157117 | A1 | 6/2015 | Seuk et al. | |
| 2015/0369567 | A1 | 12/2015 | Hall | |
| 2018/0045489 | A1 * | 2/2018 | Swan | F41H 1/02 |
| 2018/0128577 | A1 * | 5/2018 | Beck | F41H 5/0478 |
| 2018/0180388 | A1 * | 6/2018 | Beck | F41H 1/02 |
| 2019/0038007 | A1 * | 2/2019 | Swan | A41D 1/04 |
| 2019/0041167 | A1 * | 2/2019 | Swan | A41D 1/04 |
| 2020/0064105 | A1 * | 2/2020 | Richardson | F41H 5/0414 |
| 2020/0177222 | A1 * | 6/2020 | January | A41D 1/005 |
| 2020/0248989 | A1 * | 8/2020 | Swan | A44B 11/06 |

* cited by examiner

LOAD BEARING HARNESS

RELATED APPLICATIONS

This application claims priority to U.S. Provisional Application 62/539,809, filed Aug. 1, 2017 and entitled "LOAD BEARING HARNESS," the contents of which are hereby incorporated by reference for all purposes.

The present disclosure is also related to U.S. Pat. No. 9,777,997, issued Oct. 3, 2017 and entitled "PLATE CARRIER APPARATUS AND METHOD;" U.S. application Ser. No. 14/496,575, filed Sep. 25, 2014 and entitled "GEAR TRACK SYSTEM;" and U.S. Pat. No. 9,995,431, issued Jun. 12, 2018 and entitled "WEARABLE SUPPORT SYSTEM FOR LOAD DISTRIBUTION," the contents of which are hereby incorporated by reference for all purposes.

BACKGROUND

The present disclosure relates generally to systems and methods for supporting a load on a human frame, such as may be used with wearable ballistic body armor plates and accessories for military and law enforcement personnel, or other wearable load carrying harnesses used in firefighting, search and rescue, weighted exercises, infant carriage, etc.

When an individual carries a load, the load can cause a significant burden on the individual's body depending on the weight and how the load is distributed. For example, in military and certain law enforcement operations, personnel traditionally wear protective gear (e.g., flak jackets and/or ballistic plates) that protects the body from projectiles (e.g., bullets, shrapnel, and the like). The heavy protective gear, in addition to other equipment to be carried (e.g., weapons, ammunition, radios, pyrotechnics/explosives, medical kit, water, and the like), place significant weight on the shoulders of the personnel. Accordingly, the wearer can quickly become exhausted when performing even moderate exercises or drills while wearing such protective gear and the associated equipment. Furthermore, traditional protective gear can limit the wearer's range of motion, e.g. around the waist and arms, creating a potential safety hazard to the wearer, particularly in high-risk environments.

These problems are not limited to military/law enforcement equipment and personnel. Problems with load bearing mobility, fatigue, and muscle strain can also be found, for example, in firefighting, search and rescue, weighted exercise, infant carriage, or any other area in which loads are carried at least partially on or about the torso.

Although various attempts have been made to redistribute load weight, e.g. from the user's shoulders to the user's hips, many of these approaches unduly limit the user's mobility (e.g. bending, twisting, and/or running), or involve complex mechanical structures that add unwanted bulk and/or weight, and/or are cost-prohibitive for such uses. For these and other reasons, there are ongoing needs for improvements in wearable load carriage.

SUMMARY

This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter.

According to various aspects of the disclosure, a torso harness may be provided including one or more of a first chest panel; a first back panel; and/or a self-adjusting cummerbund connecting the first chest panel and the first back panel. In embodiments, the self-adjusting cummerbund may include a tensioning mechanism configured to allow the cummerbund to extend and retract.

In embodiments, the tensioning mechanism may be configured to provide varying resistive force. For example, the tensioning mechanism may be configured to provide a first resistive force when flat, and a second resistive force when curved, the second resistive force being greater than the first resistive force. In embodiments, the tensioning mechanism may be configured to allow the harness to expand, via extension of the cummerbund, as the user moves, while maintaining a constrictive pressure on the user.

In embodiments, the cummerbund may be releasably attached to at least one of the chest panel or the back panel via a quick release, the quick release including a buckle affixed to the chest panel or the back panel that is configured to flex about the Z axis, and to resist rotation relative to the Z axis. In embodiments, the buckle may be nested in a conforming portion of the chest panel or the back panel, and may be inhibited from rotating relative to the Z axis via cooperative engagement with the conforming portion of the chest panel or the back panel.

In embodiments, the tensioning mechanism may include one or more of a sliding portion, a continuous patterned length of material that is folded over itself, and an elastic member that is attached to the sliding member and the length of material.

In embodiments, the length of material may be made from HDPE, PP thermoplastic tape yarn sheeting (Tegris®), injection molded sheet material, Boltaron, PVC, PVC/acrylic alloy, and CPVC, thermoformed sheet material, extruded polymer sheets, and/or hybrid or laminated combinations thereof.

In embodiments, the sliding portion and/or the length of material may be at least partially housed within an outer cummerbund sleeve.

Embodiments may further include at least one of a second chest panel and/or a second back panel configured to hold a ballistic plate against the first chest panel and/or first back panel, respectively. That is, in some embodiments, a ballistic chest plate may be held between a first chest panel and a second chest panel, and/or a ballistic back plate may be held between a first back panel and a second back panel.

In embodiments, the second chest panel and/or second back panel may be configured to attach to the respective first chest panel and/or first back panel, via a strap of webbing that winds through the first and second panels.

In embodiments, the combination of the first chest panel and second chest panel, or the first back panel and second back panel, may be configured to allow the harness to accommodate, and hold in a fixed position, ballistic plates of different sizes and/or shapes.

In embodiments, the panels may be made of a material that is elastic when bent, but substantially inelastic in tension and/or compression, such as plastic, etc. As used in this context, "substantially" may be understood as including those materials that exhibit such characteristics under normal operational loads. That is, the material is inelastic in tension and/or compression under normal operational loads, which will be appreciated by those of skill in the art, considering the particular type of equipment.

In embodiments, the chest panel(s) and/or back panel(s) may be made of HDPE, PP thermoplastic tape yarn sheeting (Tegris®), injection molded sheet material, Boltaron, PVC, PVC/acrylic alloy, and CPVC, thermoformed sheet material, extruded polymer sheets, and/or hybrid or laminated combinations thereof.

In embodiments, the first chest panel and/or first back panel may include built-in attachment features configured to allow a second chest panel and/or a second back panel to be attached thereto.

Embodiments may further include a removable plate carrier assembly, configured to attach to the first chest panel and/or first back panel.

In embodiments, the first chest panel and/or first back panel may include built-in attachment features for securing tactical equipment thereto.

In embodiments, the harness may be incorporated in at least one of a modular ballistic plate carrier, a ski patrol or rescue harness, a weighted training vest, a baby carrier, a tactical vest, etc.

According to further aspects of the disclosure, a ballistic plate carrier may be provided including one or more of an outer chest panel; an inner chest panel; an inner back panel; an outer back panel; and/or a cummerbund connecting the outer chest panel and the outer back panel. In embodiments, the outer chest panel and the inner chest panel may be configured to hold a ballistic chest plate therebetween, and/or the outer back panel and the inner back panel may be configured to hold a ballistic back plate therebetween.

In embodiments, the outer chest panel and inner chest panel, and/or the outer back panel and inner back panel, may be configured to allow the plate carrier to accommodate, and hold in a fixed position, ballistic plates of different sizes and/or shapes.

In embodiments, the ballistic chest plate may be held in place by one or more webbing straps wound through the outer chest panel and the inner chest panel, and/or the ballistic back plate may be held in place by one or more webbing straps wound through the outer back panel and the inner back panel.

In embodiments, at least one of the webbing straps may be (a) secured to the inner chest panel or inner back panel via a flat friction lock that is formed at least partially of the inner chest panel or inner back panel, and (b) adjustable via the flat friction lock.

In embodiments, at least one of the outer chest panel and the outer back panel may include a cummerbund attachment mechanism that is configured to flex about the Z axis, and/or to resist rotation relative to the Z axis.

In embodiments, at least one of the inner chest panel and the inner back panel may include a waist extension that extends beyond a footprint of the respective ballistic chest plate or ballistic back plate, and that is overlapped by the cummerbund when the plate carrier is worn. In embodiments, the waist extension may include built-in attachment features for securing tactical gear to the waist extension.

In embodiments, at least one of the outer chest panel and the outer back panel may include a plurality of built-in attachment features configured to mount tactical equipment thereto.

In embodiments, the outer chest panel, the inner chest panel, the outer back panel, and/or the inner back panel may be made of a material that is elastic when bent, but substantially inelastic in tension and/or compression, such as sheet plastic.

In embodiments, the outer chest panel, the inner chest panel, the outer back panel, and/or the inner back panel may be made of HDPE, PP thermoplastic tape yarn sheeting (Tegris®), injection molded sheet material, Boltaron, PVC, PVC/acrylic alloy, and CPVC, thermoformed sheet material, extruded polymer sheets, and/or hybrid or laminated combinations thereof.

In embodiments, the cummerbund may include a tensioning mechanism comprising one or more of a sliding portion, a continuous patterned length of material that is folded over itself, and an elastic member that is attached to the sliding portion and/or the length of material. In embodiments, the length of material may be made from HDPE, PP thermoplastic tape yarn sheeting (Tegris®), injection molded sheet material, Boltaron, PVC, PVC/acrylic alloy, and CPVC, thermoformed sheet material, extruded polymer sheets, and/or hybrid or laminated combinations thereof.

In embodiments, the sliding portion and/or the length of material may be at least partially housed within an outer cummerbund belt or sleeve.

In embodiments, various torso harnesses and/or carriers described herein may be configured with attachment features for mounting equipment thereto. For example, an attachment feature may include a first connector fixedly attached to the harness and/or carrier, and an accessory holder may be configured to attach to the harness and/or carrier via a complementary second connector that is fixedly attached to the accessory holder. Embodiments may include a release mechanism for releasing the accessory holder from the harnesses and/or carrier. In embodiments, the first connector and second connector may be configured to engage with one another so as to allow the accessory holder to be mounted to and removed from the harnesses and/or carrier. In embodiments, the first connector and second connector may be attachable to one another using a female member of the first connector and a male member of the second connector, or vice versa. In embodiments, the release mechanism may include at least one deflecting component integrally formed or joined with the attachment feature or accessory holder, and configured to be manipulated by a user's finger to allow the accessory holder to be removed from the harnesses and/or carrier. In embodiments, the attachment feature of the harness and/or carrier may include a plurality of first connectors arranged in fixed positions and configured to mount a plurality of accessory holders thereto.

According to further aspects of the disclosure, a webbing buckle may be provided including one or more of a first portion that is integrally formed with a load bearing strap, frame or harness, and a second portion that is made of a rigid material and that at least partially overlaps the first portion. In embodiments, the buckle may be configured to (a) seize a piece of webbing in a jaw formed by the first portion and the second portion when the piece of webbing is woven through the first portion and the second portion and the piece of webbing is put under tension in a first direction, and to (b) release the piece of webbing when the tension in the first direction is removed and tension is applied to the piece of webbing in a second direction, e.g. 90°-180° off of the first direction.

In embodiments, the load bearing strap, frame or harness may be made from a panel of material and the first portion is a patterned portion, of the material. In embodiments, the sheet of material may be made from HDPE, PP thermoplastic tape yarn sheeting (Tegris®), injection molded sheet material, Boltaron, PVC, PVC/acrylic alloy, and CPVC, thermoformed sheet material, extruded polymer sheets, and/or hybrid or laminated combinations thereof.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

Figure 1:
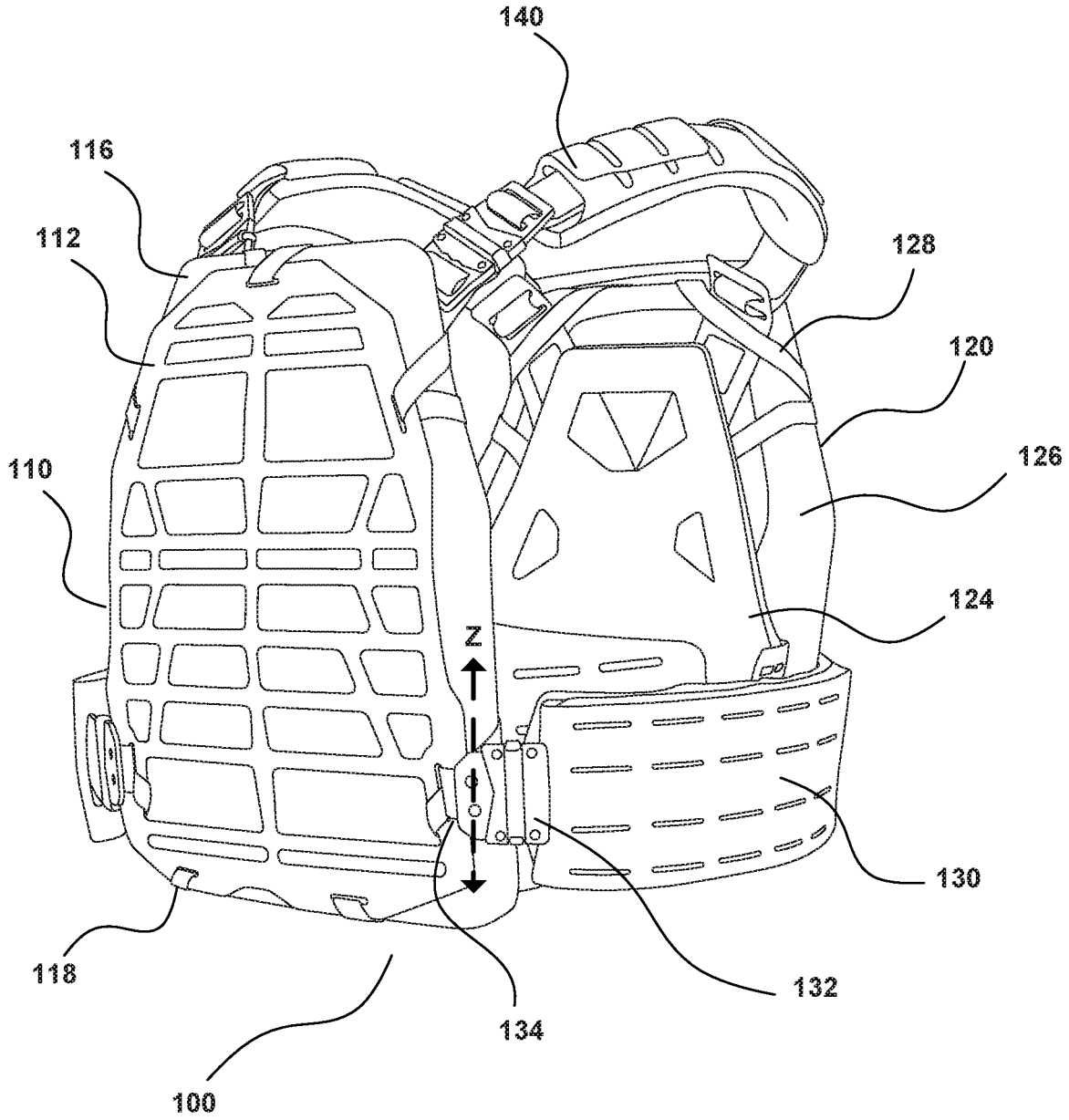
FIG. 1 is a front perspective view of a wearable load redistribution system according to certain aspects of the present disclosure.

It is to be expressly understood that the description and drawings are only for the purpose of illustrating certain embodiments of the invention and are an aid for understanding. They are not intended to be a definition of the limits of the invention.

DETAILED DESCRIPTION OF EMBODIMENTS

It is understood that the invention is not limited to the particular methodology, protocols, etc., described herein, as these may vary as the skilled artisan will recognize. It is also to be understood that the terminology used herein is used for the purpose of describing particular embodiments only, and is not intended to limit the scope of the invention. It also is to be noted that as used herein and in the appended claims, the singular forms "a," "an," and "the" include the plural reference unless the context clearly dictates otherwise. Thus, for example, a reference to "a support" is a reference to one or more supports and equivalents thereof known to those skilled in the art.

Unless defined otherwise, all technical terms used herein have the same meanings as commonly understood by one of ordinary skill in the art to which the invention pertains. The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law.

Figure 2:
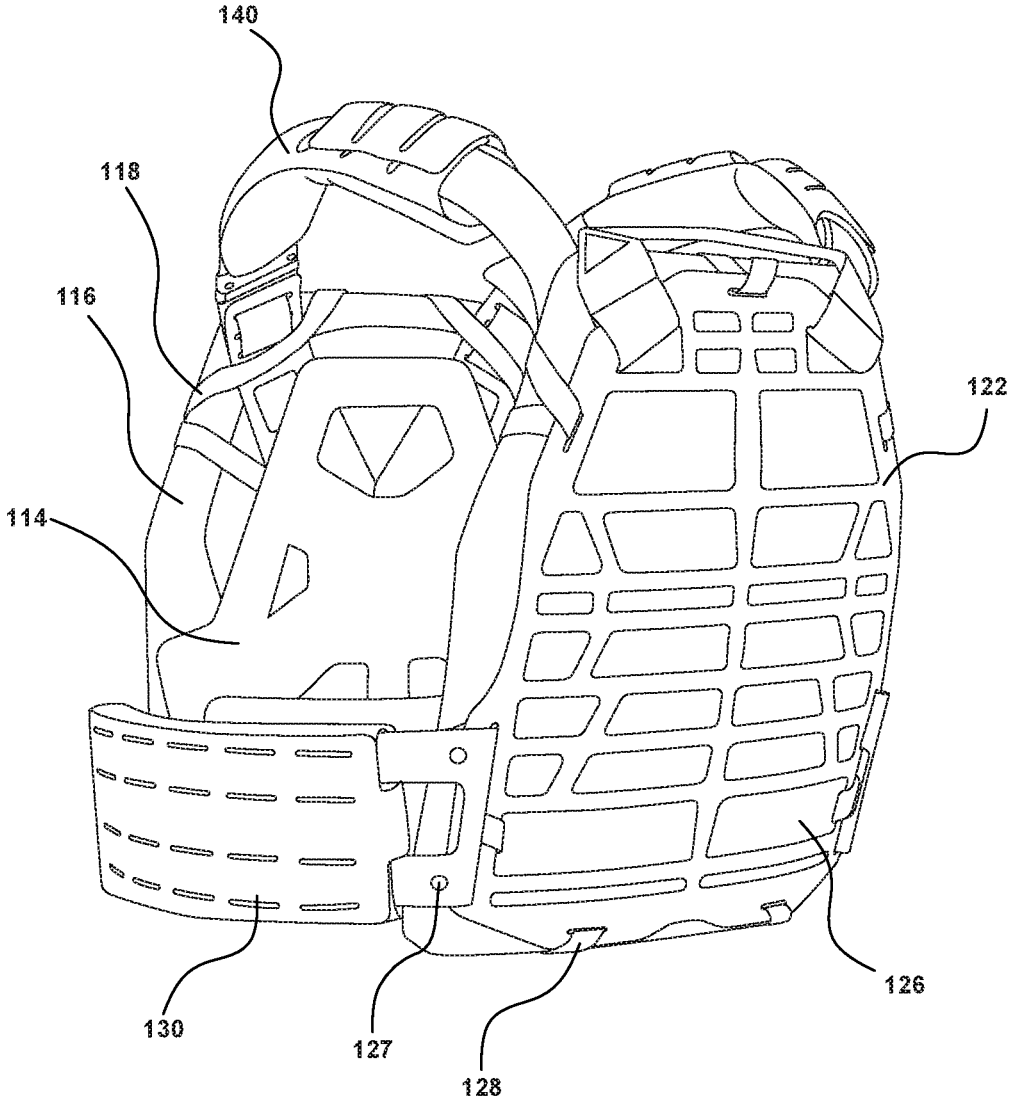
FIG. 2 is a rear perspective view of a wearable load redistribution system as shown in FIG. 1.

FIG. 1 is a front perspective view, and FIG. 2 is a rear perspective view, of a wearable load carriage system 100 according to certain aspects of the present disclosure. Load carriage system 100 can be worn around a thorax region (e.g., upper torso) of a wearer. Load carriage system 100 can redistribute a load such that at least a portion of the load is disbursed from shoulders of wearer and redistributed about the torso of wearer. In some embodiments, the load can be a weight of the front plate assembly 110 and/or back plate assembly 120. In other embodiments, the load can be a weight of one or more additional objects (e.g., a water canister, firearm magazines, ordnance, ammunition, radios, first aid kit, and other suitable objects) attached to wearable load distribution system 100. For example, a load can be attached (e.g., hung from or mounted to) a portion of the front plate assembly 110, back plate assembly 120, and/or cummerbund element(s) 130, as further discussed below.

In certain embodiments, load carriage system 100 may be a modular system. The load carriage system can be covered by various fabrics or padding so that none of, or only a portion of, wearable load carriage system 100 is exposed when worn. In some embodiments, wearable load carriage system 100 can include front plate assembly 110, shoulder straps 140, back plate assembly 120, and cummerbund elements 130.

Front plate assembly 110 may include an outer chest panel 112, inner chest panel 114, and/or ballistic chest plate 116.

Likewise, back plate assembly 120 may include an outer back panel 122, inner back panel 124, and/or ballistic back plate 126. In this case, the ballistic chest plates 116, 126 are held between the outer panels 112, 122, and the inner panels 114, 124, respectively, although other embodiments may not necessarily include both outer and inner panels in the front and/or back plate assemblies, e.g. as discussed in U.S. application Ser. No. 13/506,182, filed Apr. 2, 2012 and entitled "PLATE CARRIER APPARATUS AND METHOD."

As discussed further below, the outer chest panel 112 may be attached to the inner chest panel 114, and squeeze the ballistic chest plate 116 therebetween, via one or more straps of webbing 118 that wind through openings in the outer chest panel 112 and the inner chest panel 114. Likewise, the outer back panel 122 may be attached to the inner back panel 124, and squeeze the ballistic back plate 126 therebetween, via one or more straps of webbing 128 that wind through openings in the outer back panel 122 and the inner back panel 124.

The outer panels 112, 122, also have built-in attachment features (e.g., holes therethrough) that allow tactical equipment to be attached to the load carriage system 100. For example, the panels 112, 122 (or other rigid panel components described herein) may include a number of holes therein of different sizes and shapes for performing various purposes, including for inserting the webbing straps 118, 128 therethrough and for attaching various equipment (e.g., tactical equipment such as pockets, pouches, holsters, backpacks, etc.) to the load carriage system 100. The load carriage system 100 may be designed as shown in the figures so that the holes therein are shaped to allow attaching of specific tactical equipment, pockets, pouches, backpacks, etc. to the holes. In one example, the one or more pouches may have tabs that extend through the holes in the panels and then wrap around the panel back onto themselves, and the portions of the tabs which overlap themselves may be attached to one another using, for example one or more hook and loop fasteners (e.g., Velcro®) or what is referred to as a "tuck-tab." In some embodiments, such features may also include built-in attachment mechanisms.

For example, similar to attachment systems described in U.S. application Ser. No. 14/496,575, filed Sep. 25, 2014 and entitled "GEAR TRACK SYSTEM, a built-in attachment feature may include a connector element that is fixedly attached to the outer chest panel 112 and/or other parts of the load carriage system 100 (which may be referred to as the "harness" for ease of description), and an accessory holder (such as a firearm magazine holder) may be configured to attach to the harness via a complementary connector element that is fixedly attached to the accessory holder. Embodiments may include a release mechanism for releasing the accessory holder from the harness. In embodiments, the connector elements may be configured to engage with one another so as to allow the accessory holder to be mounted to and removed from the harness.

In embodiments, connectors may be attachable to one another using a female member of one connector and a male member of the other connector. In embodiments, the release mechanism may include at least one deflecting component integrally formed or joined with the attachment feature (or accessory holder), and configured to be manipulated by a user's finger to allow the accessory holder to be removed from the outer chest panel 112. Preferably, the deflecting component is part of the harness's connector, and the accessory holder's connector is configured to deflect the deflecting component as the two connectors engage. The deflecting component may be further configured to snap back to a locked position when the connector of the accessory holder is fully seated in the connector of the harness.

In embodiments, the attachment feature of the harness may include a plurality of connectors arranged in fixed positions and configured to mount a plurality of accessory holders thereto.

In embodiments, the panels 112, 114, 122, 124 may be made of a "rigid" material, which, as used herein, should be understood as including those materials that, in appropriate thicknesses, resist deformation under operational loads, as well as those that naturally return to their original shape after deformation (e.g. bending) under operational loads. Such materials may preferably include, for example, plastics, laminates, etc. In embodiments, the panels 112, 114, 122, and/or 124 may be made of HDPE, PP thermoplastic tape yarn sheeting (Tegris®), injection molded sheet material, Boltaron, PVC, PVC/acrylic alloy, and CPVC, thermoformed sheet material, extruded polymer sheets, and/or hybrid or laminated combinations thereof.

By making the panels 112, 114, 122, 124, out of these types of material, the panels (or other components described herein) may be substantially (i.e. greater than 90%) liquid, chemical, and biohazard resistant. These types of material can also be easily decontaminated. Forming the panels from these types of material also eliminates any extra weight being added to the material when the load carriage system 100 is submerged in water.

As shown in FIG. 1, the panels 112, 114, 122, 124 may also have unnecessary material removed, e.g. to decrease the weight that is loaded on the user. In such cases, the panels may include a continuous outer perimeter, with voids inside the perimeter that may equal, for example, 50% or more of the total surface area of the panel.

The chest and back plates 116, 126, provide ballistic protection to the wearer. The plates 116, 126 may include any type or material of body armor plate which provides ballistic protection to the wearer known to those skilled in the art. The level of protection of the body armor plate is typically specified by the armor manufacturer and could range from protection from low-velocity projectiles (e.g. shrapnel) to protection from high-velocity rifle bullets. One example of materials which the body armor plate may be constructed from includes a formed, rigid ceramic plate with a soft woven Kevlar backing, the ceramic plate and backing sandwiched together into one singular plate.

In some embodiments, the panels 112, 114, 122, and/or 124 may generally correspond to the size, shape, and curvature of the ballistic plate 116 and/or 126. In this regard, the outer chest panel 112 and/or inner chest panel 114 may generally correspond (at least partially) to the size, shape, and curvature of the chest plate 116, and the outer back panel 122 and/or inner back panel 124 may generally correspond (at least partially) to the size, shape, and curvature of the back plate 126. However, in embodiments that use a "cinching" mechanism, such as webbing straps 118, 128, the outer perimeters of the panels may be smaller than, and/or include portions that extend within, the outer perimeter of the corresponding ballistic plate. This can allow, for example, the load carriage system 100 to accommodate, and hold in a fixed position, ballistic plates of different sizes and/or shapes.

As discussed further below, the cummerbund element(s) 130 may be "self-adjusting," and include a tensioning mechanism configured to allow the cummerbund to extend and retract while being worn by the user, and during donning and removing the load carriage system 100.

The cummerbund element 130 may be releasably attached to the chest panel (and/or the back panel) via a quick release at buckle 132. A cooperating buckle 134 of the quick release mechanism is affixed to the outer chest panel 112 (and/or the outer back panel), and is configured to flex about the Z axis (i.e. in and out of the page of FIG. 1), and to resist rotation relative to the Z axis (i.e. up and down in FIG. 1). This may be accomplished, for example, by nesting the buckle 134 in a conforming portion (e.g. a "cutout") of the outer chest panel 112 (and/or the outer back panel 122), which can inhibit rotation of the buckle 134 relative to the Z axis via cooperative engagement with the conforming portion. This arrangement is beneficial in many ways, including allowing the cummerbund element 130 to engage with the buckle 134 from different angles relative to the face of outer chest panel 112 (which can allow gear to be mounted under the cummerbund element 130), allowing the buckle 134 to be "pulled away" from the face of outer chest panel 112 (which can allow for easier access, and attachment, to the buckle 134), and allowing loads to be more effectively distributed between the front plate assembly 110, cummerbund element 130, and back plate assembly 120.

In the embodiments shown in FIG. 2, the cummerbund element 130 is attached to outer back panel 122 via screws 127 (or other fasteners). These attachment points provide stability to the cummerbund element 130 and assist in distributing loads between the front and back assemblies, and about the torso. In this regard, the attachment of the cummerbund element 130 and outer back panel 122 is configured to flex about the Z axis (i.e. in and out of the page of FIG. 2) via flexion of the cummerbund material at the attachment, and to resist rotation relative to the Z axis (i.e. up and down in FIG. 2) via the two screw attachments at the top and bottom and the relative rigidity of the cummerbund material (and structure) in the vertical direction.

As used herein, attachments like screws 127 that typically require tools to attach and/or detach may be referred to as "fixed attachments" and distinguished from other "quick-release" attachments, such as Velcro®, side release buckles, slot connectors, etc., that may be readily attached and/or detached without tools. Unless otherwise specified, "fixed attachments" may also include attachment means that are not intended to be taken apart, such as rivets, welds, etc.

It should also be appreciated that, although the embodiment depicted in FIGS. 1 and 2 has the cummerbund element 130 attached to the outer chest and outer back panels 112, 122, other embodiments may change this arrangement, e.g. to include similar attachments to the inner front and/or inner back panels 114, 124, including embodiments which may not include one, or either, outer panels.

Figure 8:
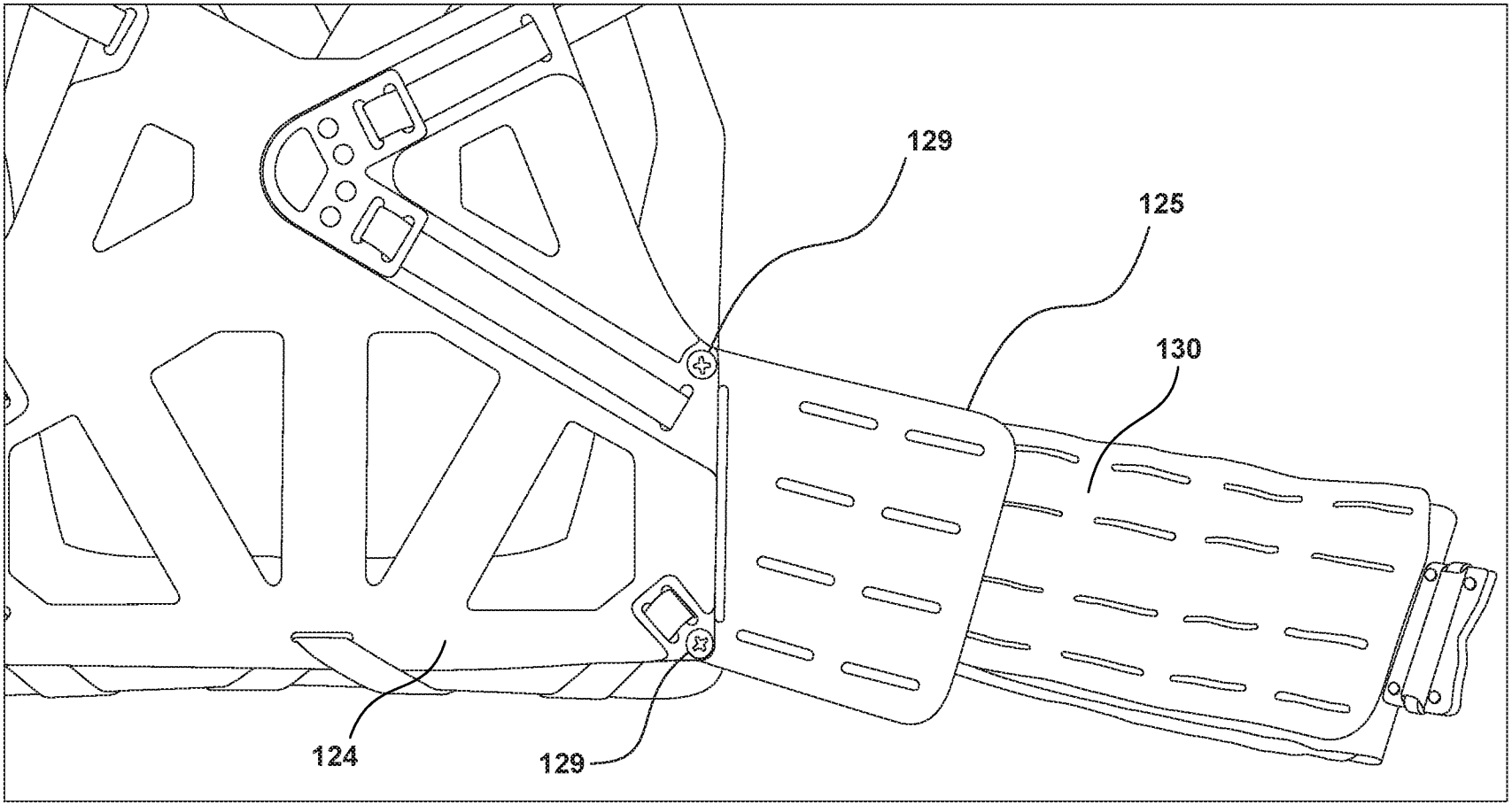
FIG. 8 is another view of an inner panel including a removable panel extension and cummerbund according to certain aspects of the present disclosure.
Figure 9:
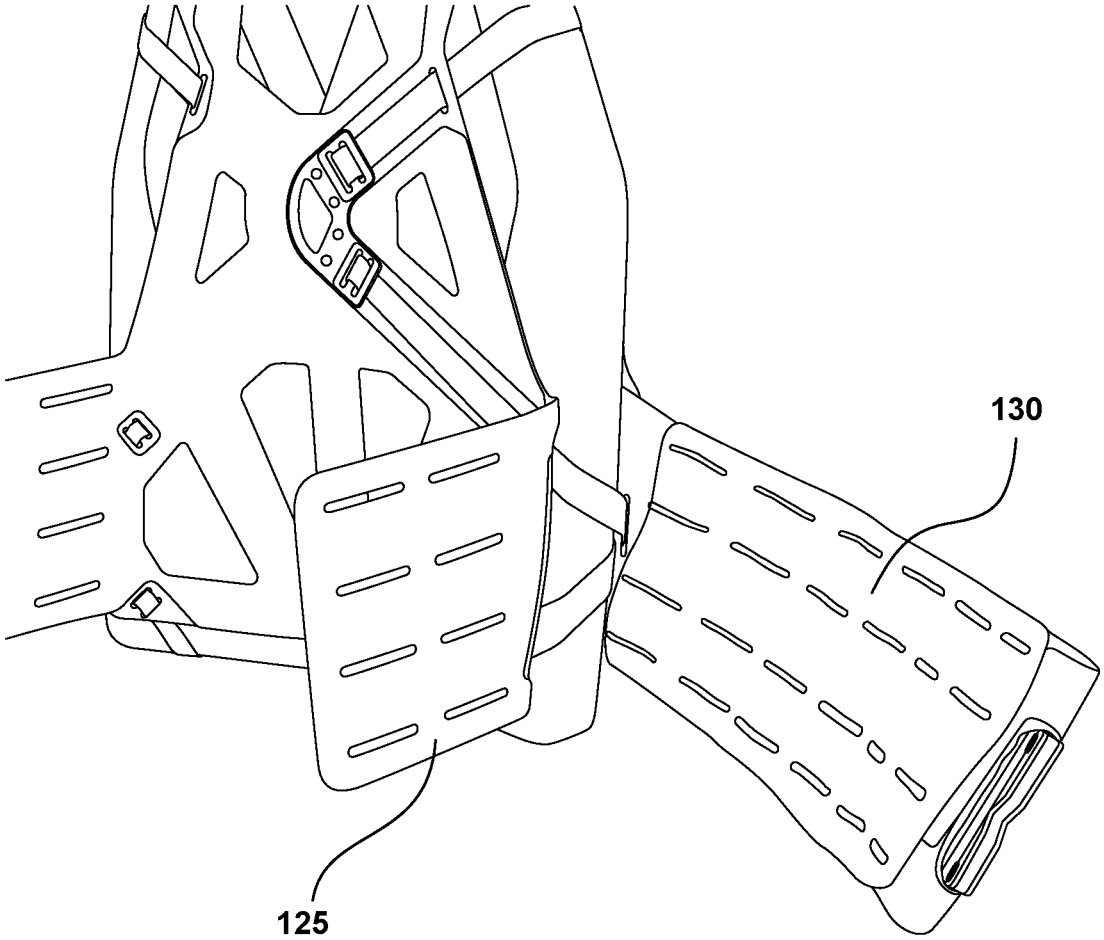
FIG. 9 is another view of an inner panel including a removable panel extension according to certain aspects of the present disclosure.

In some embodiments, the panels 112, 114, 122, and/or 124 may include, or be joined with, panel extensions, e.g. additional panel portions that may be constructed with similar materials and/or attachment features, and that increase the effective size of the panel. These may be attached to and/or formed in a lower portion of the panel, and may general extend under the arms of the user in the vicinity of the cummerbund element(s) 130. For example, the inner chest panel 114 may include and/or be attached to chest panel extensions 115 (as shown in FIG. 4), and/or the inner back panel 124 may include and/or be attached to back panel extensions 125 (as shown in FIGS. 8 and 9).

Figure 3:
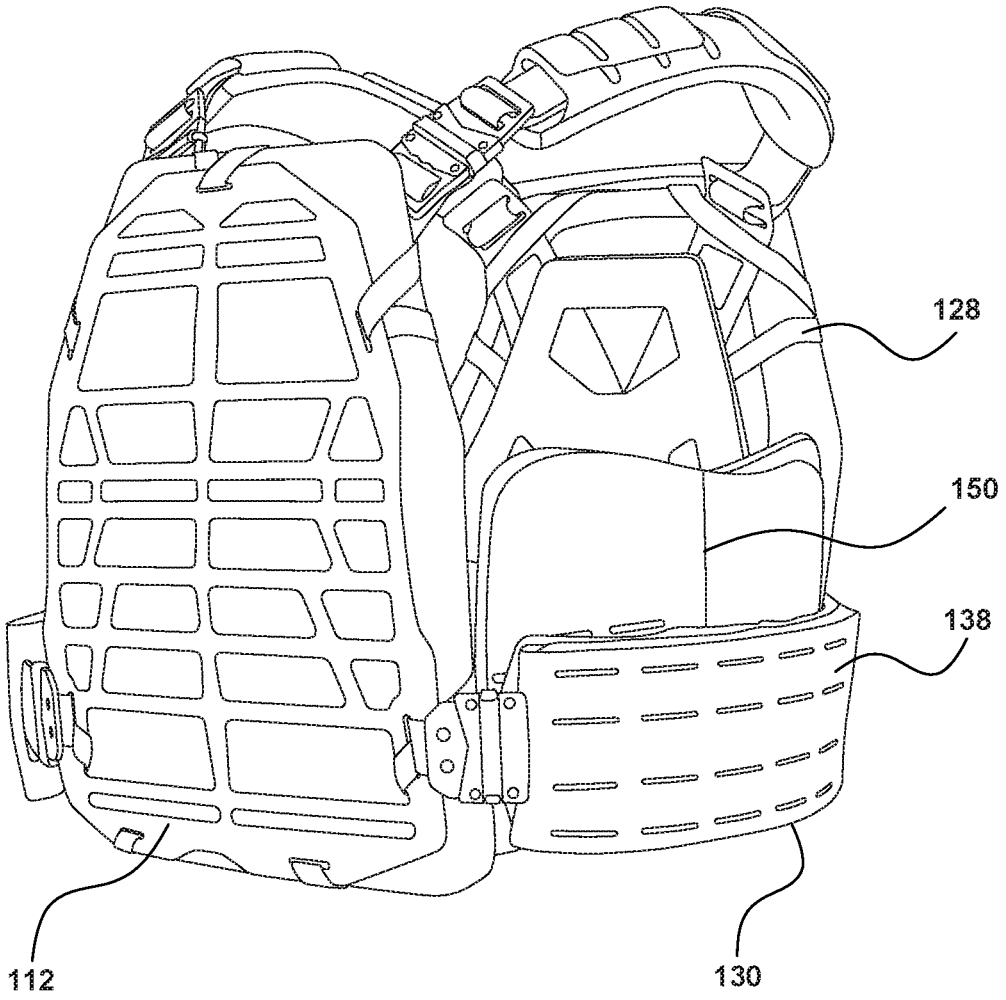
FIG. 3 is a front perspective view of a wearable load redistribution system, including side armor, according to certain aspects of the present disclosure.

As shown in FIG. 3, embodiments may also include side armor 150 that is attached to and/or supported by the cummerbund element and/or panel extensions. For example, the outer sleeve 138 of the cummerbund element 130 may include a Velcro® portion that secures to a complementary Velcro® portion of the side armor 150 and/or at least part of the side armor 150 may engage with back panel extension 125. Side armor 150 may include any variety of body armor known in the art, and may include an outer cover configured to engage with the cummerbund element 130 and/or chest or back panel extension. In the embodiment shown in FIG. 3, it should be appreciated that the side armor 150 can be securely held and supported by the outer sleeve 138, while still allowing inner element(s) of the cummerbund 130 to move, as described further herein.

In embodiments, various other tactical items may be secured to panel extensions and/or side armor in the vicinity of the cummerbund element 130. This may be accomplished, at least in some examples, by providing attachment features to the panel extensions and/or side armor, and due to the extendibility of the cummerbund element, which allows it to provide additional space (between the panel extensions and/or side armor) in which the additional items may be accommodated.

Figure 4:
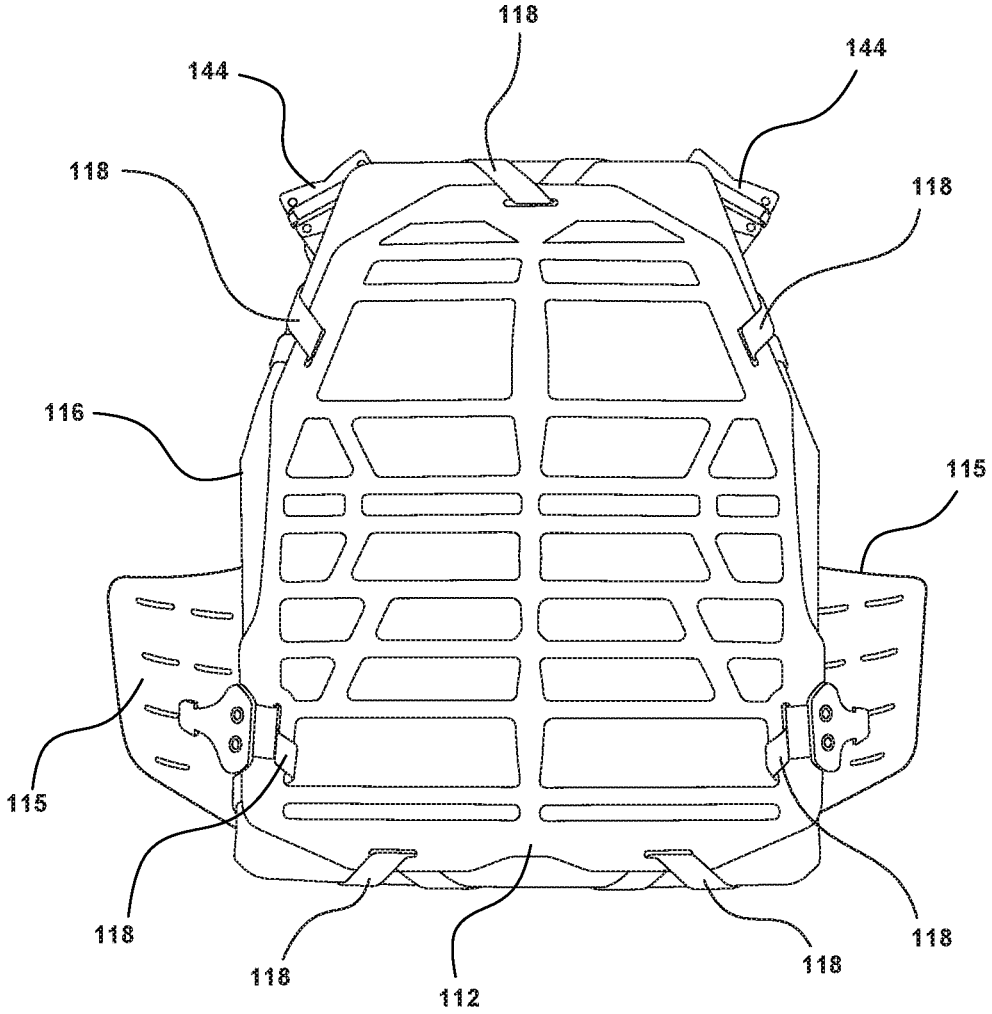
FIG. 4 shows an outer panel including securing straps and gear attachment features according to certain aspects of the present disclosure.

FIG. 4 highlights further details regarding securing straps and gear attachment features according to aspects of the disclosure. As shown in FIG. 4, the outer chest panel 112 includes chest panel extensions 115, as well as slots through which webbing straps 118 are wound. Chest panel extensions 115 include slots configured to function as attachment features. Buckles 144 may also be affixed to the upper part of the outer chest panel 112 to provide for rapid attachment and detachment of the shoulder straps 140.

In some examples, the webbing straps 118 may be two pieces of webbing, e.g. with one webbing strap 118A securing the upper portion of the front plate assembly, and another webbing strap 118B securing the lower portion of the front plate assembly. An embodiment with this configuration is shown in FIGS. 5 and 6.

Figure 5:
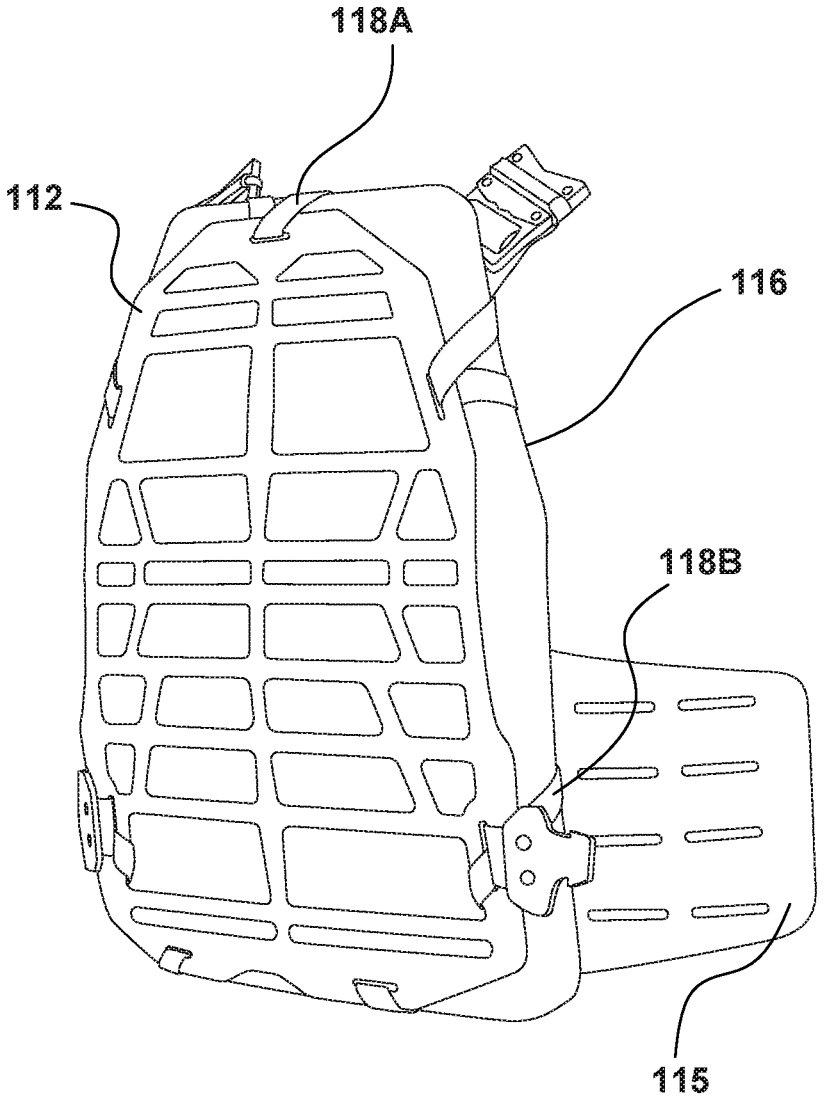
FIG. 5 is a perspective view of an outer panel including securing straps and gear attachment features according to certain aspects of the present disclosure.

FIG. 5 is a perspective view of an outer panel including securing straps and gear attachment features according to certain aspects of the present disclosure. As shown in FIG. 5, the webbing strap 118A is wound through an upper portion of the outer chest panel 112, and another webbing strap 118B is wound through a lower portion of the outer chest panel 112. Inner chest panel 114 also includes a panel extension 115 with built-in attachment features.

Figure 6:
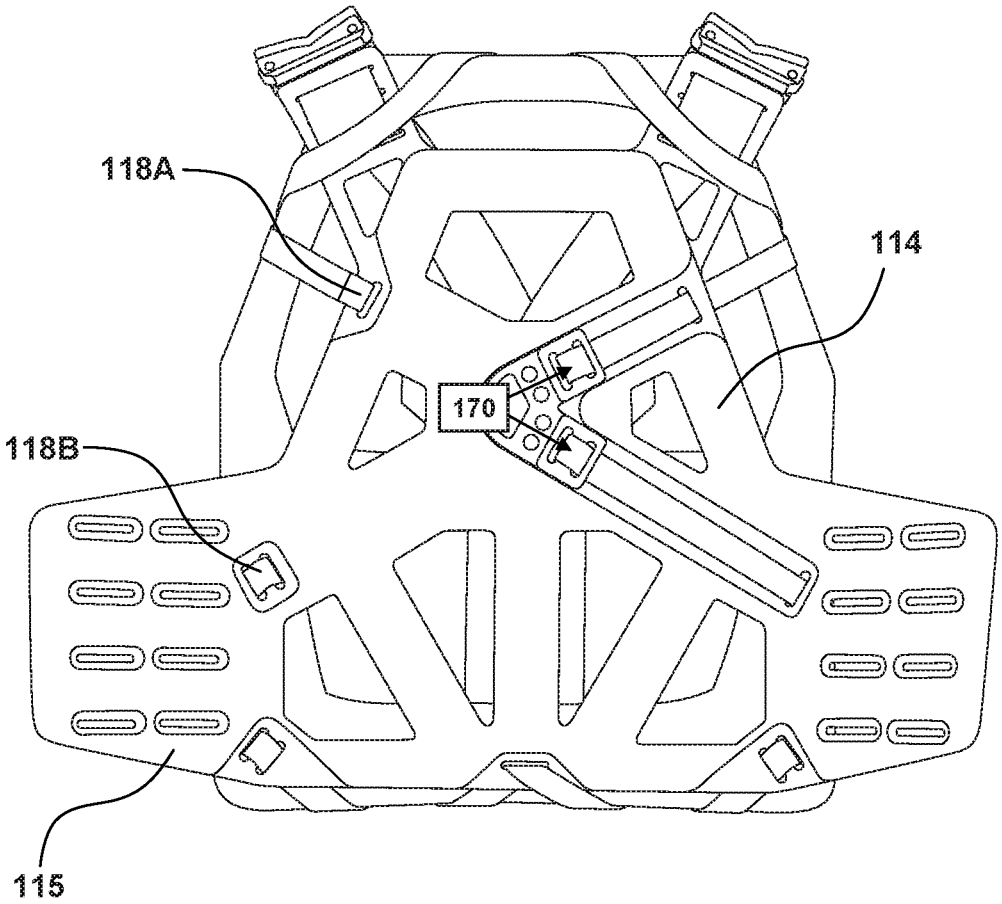
FIG. 6 shows an inner panel including securing straps and flat friction lock features according to certain aspects of the present disclosure.

FIG. 6 shows an inner panel including securing straps and flat friction lock features according to certain aspects of the present disclosure. Each of webbing straps 118A and 118B may have a standing end that is fixed or otherwise attached to inner chest panel 114, and a free end that is routed through slots in the outer chest panel 112 and inner chest panel 114, and through flat friction lock 170. The ballistic chest plate 116 may thereby be securely fastened in a fixed position between outer chest panel 112 and inner chest panel 114. It should be further appreciated that, using this configuration, a variety of differently sized and/or shaped ballistic chest plates may be accommodated by the front plate assembly 110. The plate assembly 120 may be constructed in similar manner, and may accommodate differently sized and/or shaped ballistic back plates. However, in other embodiments, such as discussed below with reference to FIGS. 12-14, a harness may be constructed with the back having a different configuration than that of the front, or vice versa, e.g. to accommodate a modular system with a removable back plate assembly, back pack, etc.

Figure 7:
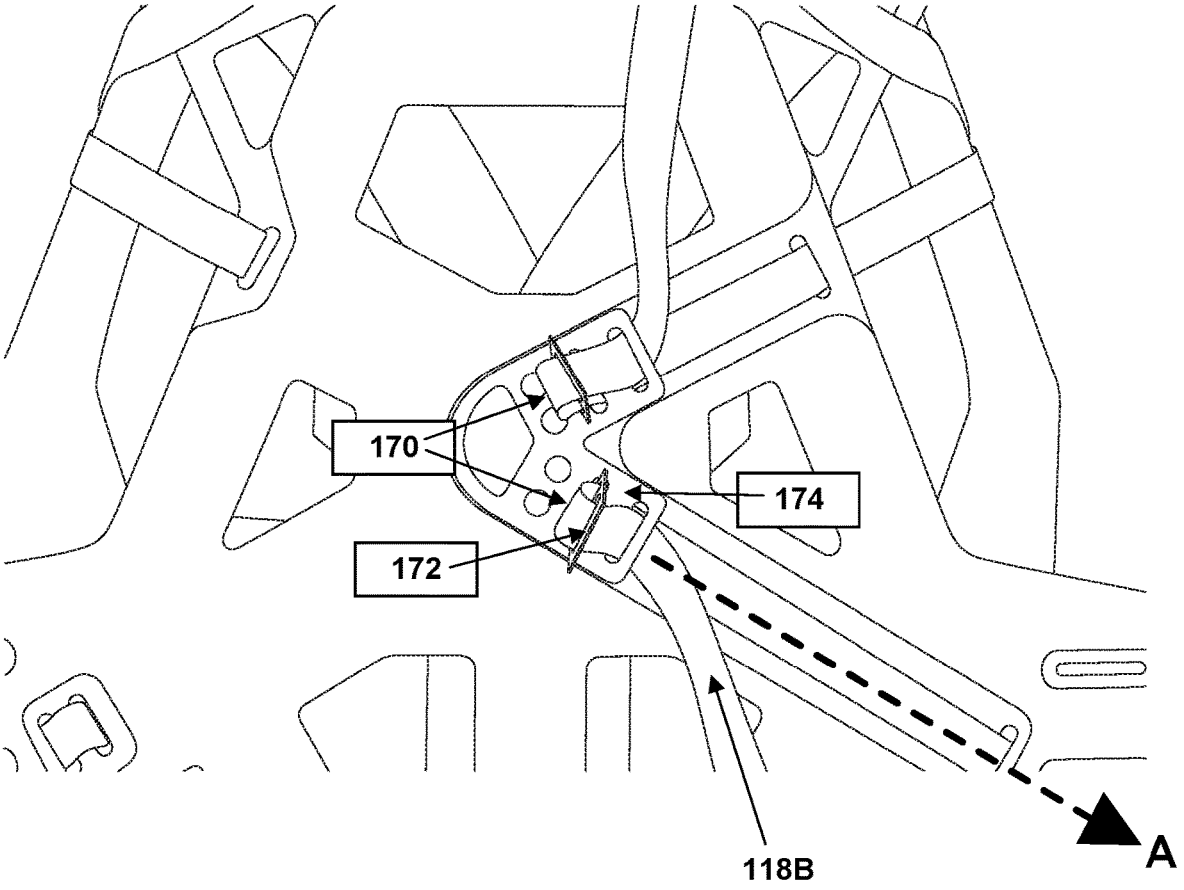
FIG. 7 is another view of an inner panel including a flat friction lock according to certain aspects of the present disclosure.

FIG. 7 shows additional details of the flat friction lock 170. As shown in FIG. 7, each of flat friction locks 170 may include a first portion 172 (which may be made of a relatively flexible material, such as HDPE, PP thermoplastic tape yarn sheeting (Tegris®), injection molded sheet material, Boltaron, PVC, PVC/acrylic alloy, and CPVC, thermoformed sheet material, extruded polymer sheets, and/or hybrid or laminated combinations thereof) and second portion 174 that is made of a relatively inflexible material (such as metal). The second portion 174 at least partially overlaps the first portion 172 such that, when a webbing strap is wound through slots in the first portion 172 and second portion 174, and pulled in a first direction (e.g. along arrow "A") the webbing strap is seized in a jaw formed by the slots in the first portion 172 and second portion 174. The flat friction lock 170 may then be released by pulling the webbing strap in a second direction, e.g. in a range of 90° to 180° off of the first direction (such as perpendicular out of the page of FIG. 7 around to a direction that is substantially opposite of arrow "A").

The first portion 172 shown in FIG. 7 is an integrally formed and patterned piece of the panel itself, however, in other embodiments, the first portion may be formed of a separate piece of flexible material that is attached to the panel, or any other load bearing strap, belt, frame, or harness. The second portion 174 is fixedly attached to the panel (via rivets or any other suitable means), which prevents movement of the second portion relative to the panel in the direction of arrow "A."

As will be appreciated by the example shown in FIG. 7, the relative flexibility of the first portion 172 allows the webbing to be easily fed through flat friction lock 170, and for the friction lock to be easily released via tension in the second direction. The configuration of the flat friction lock also allows for an extremely low-profile design that is particularly well suited for placement on the inside of load bearing straps, belts, frames, harnesses, etc. In this regard, each of the first and/or second portions may be formed of material(s) with a thickness that is, for example, in a range of 1.0-2.0 mm, in a range of 0.5-1.5 mm, or less than 1.5 mm. Accordingly, the overall thickness of the flat friction lock 170 may be, for example, in a range of 2.0-4.0 mm, in a range of 1.0-3.0 mm, or less than 1.5 mm.

FIG. 8 is another view of an inner back panel including a removable panel extension and cummerbund element according to certain aspects of the present disclosure. As shown in FIG. 8, panel extension 125 may be attached to inner back panel 124 via attachment screws 129, providing a secure and stable platform that allows panel extension 125 to bear the weight of, for example, various accessories described herein. Accessories may be mounted to panel extension 125 using any means described herein, as well as other means that may be known in the art, and may locate such accessories at least partially between the panel extension 125 and the cummerbund element 130, e.g. in the area between panel extension 125 and the cummerbund element 130 shown in FIG. 9. Such placement may be advantageous for several reasons, such as taking advantage of otherwise unused carrying space around the torso, maintaining certain equipment in the event that ballistic plates (and supporting cummerbund) are removed by the user, additional gear stability (e.g. reducing jostling) via compression by the cummerbund element, etc.

Figure 10:
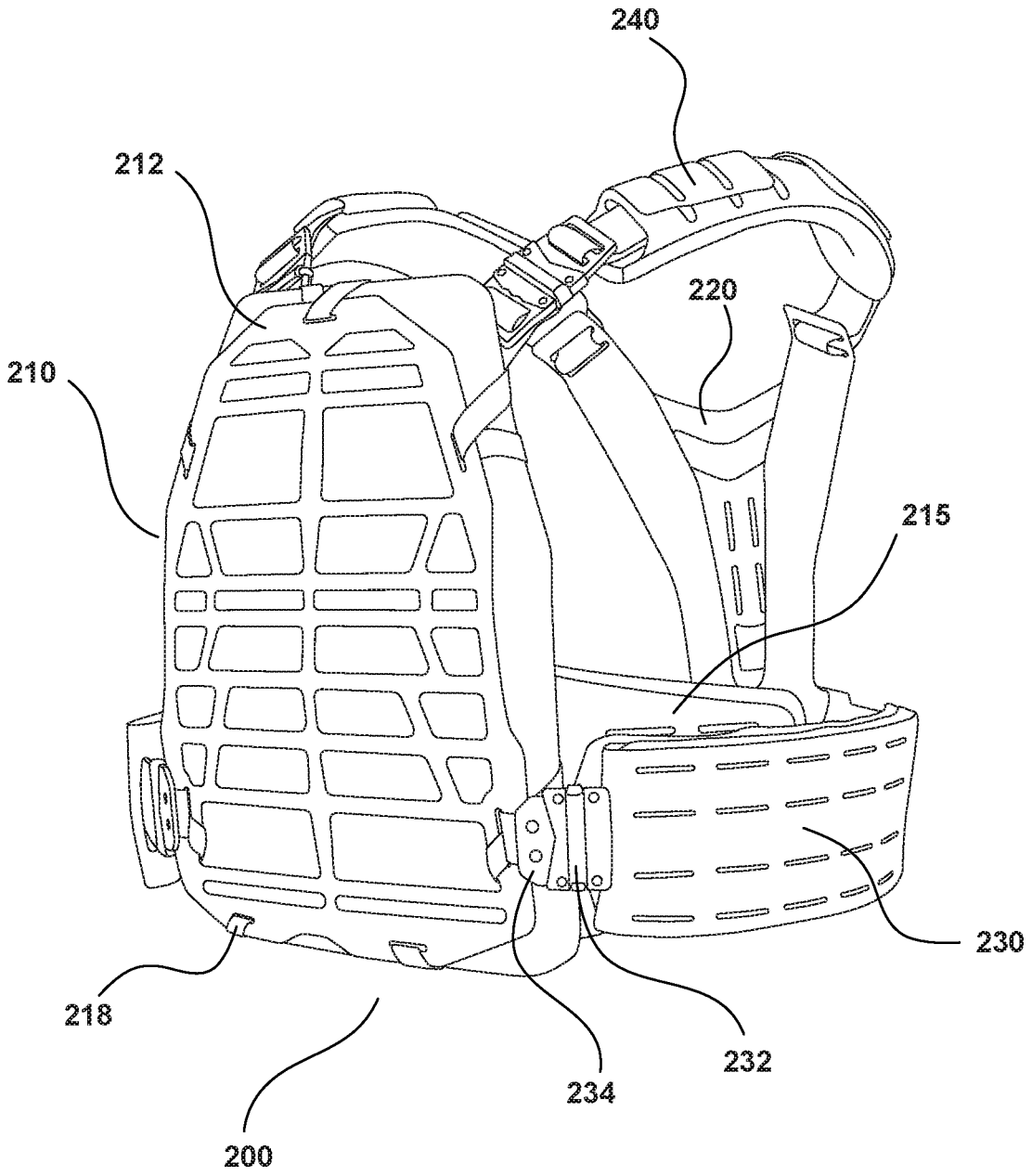
FIG. 10 is a front perspective view of another wearable load redistribution system according to certain aspects of the present disclosure.

FIG. 10 is a front perspective view of another wearable load carriage system according to certain aspects of the present disclosure. Like load carriage system 100 described above, the load carriage system 200 shown in FIG. 10 can be worn around a thorax region (e.g., upper torso) of a wearer. Load carriage system 200 can redistribute a load such that at least a portion of the load is disbursed from shoulders of wearer and redistributed about the torso of wearer. In some embodiments, the load can be a weight of the front plate assembly 210 and/or any loads attached to back harness panel 220. In other embodiments, the load can be a weight of one or more additional objects (e.g., a water canister, firearm magazines, ordnance, ammunition, radios, first aid kit, and other suitable objects) attached to wearable load carriage system 200. For example, a load can be attached (e.g., hung from or mounted to) a portion of the front plate assembly 210, back harness panel 220, and/or cummerbund element(s) 230, as further discussed below.

In certain embodiments, load carriage system 200 may be a modular system. The wearable load carriage system can be covered by various fabrics or padding so that none of, or only a portion of, wearable load carriage system 200 is exposed when worn. In some embodiments, load carriage system 200 can include front plate structure 210, shoulder straps 240, back harness panel 220, and cummerbund elements 230.

Front plate assembly 210 may be constructed in a similar manner to front plate assembly 110 in FIG. 1, and may include an outer chest panel 212, inner chest panel 214, and/or ballistic chest plate 216. In this case, the ballistic chest plate 216 is held between the outer panel 212 and the inner panel 214, although other embodiments may not necessarily include both outer and inner panels in the front and/or back plate assemblies, e.g. as discussed in U.S. application Ser. No. 13/506,182, filed Apr. 2, 2012 and entitled "PLATE CARRIER APPARATUS AND METHOD."

As discussed elsewhere herein, the outer chest panel 212 may be attached to the inner chest panel 214, and squeeze the ballistic chest plate 216 therebetween, via one or more straps of webbing 218 that wind through openings in the outer chest panel 212 and the inner chest panel 214.

A cummerbund element 230 may attach the front plate assembly and the back harness panel 220. The cummerbund element 230 may be a self-adjusting and/or extending cummerbund as described elsewhere herein. The back harness panel 220 may be constructed in similar manner, using similar materials, to other panels described herein, such as panels 112, 114, 122, 124.

Figure 11:
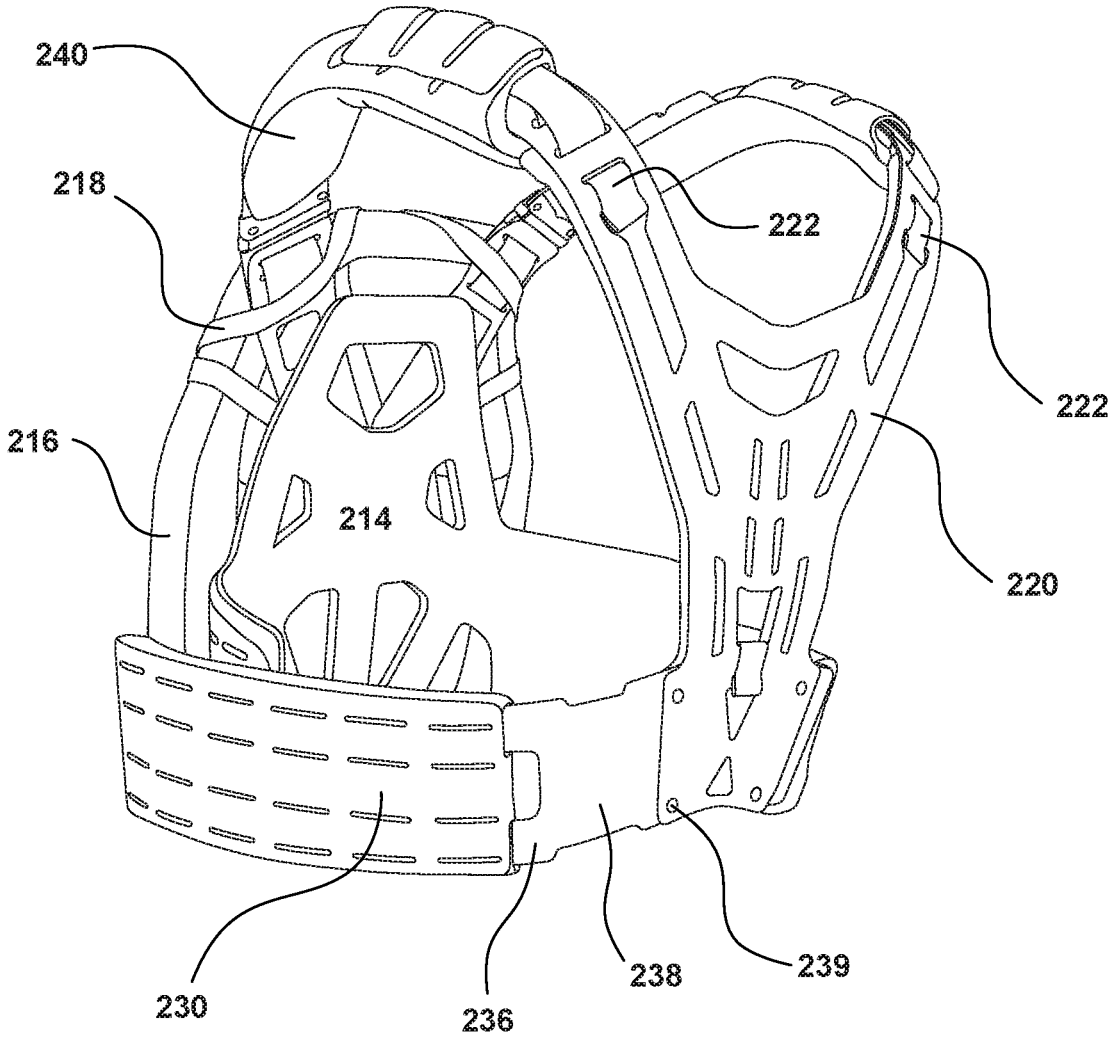
FIG. 11 is a rear perspective view of a wearable load redistribution system as shown in FIG. 12.

FIG. 11 is a rear perspective view of the wearable load carriage system 200 as shown in FIG. 10. As can be seen in FIG. 11, the load carriage system 200 may include an inner front panel 214 (in this case partially covered by a piece of padding/flotation), a cummerbund belt 236, a belt attachment feature 238, securing elements 239, and back pack attachment features 222 secured to back harness panel 220. As discussed further herein, the belt attachment feature 238 and/or the back pack attachment features 222 may be used to secure various pieces of modular gear, such as pack plate assemblies, backpacks, radios, etc. to the back harness panel 220.

Figure 12:
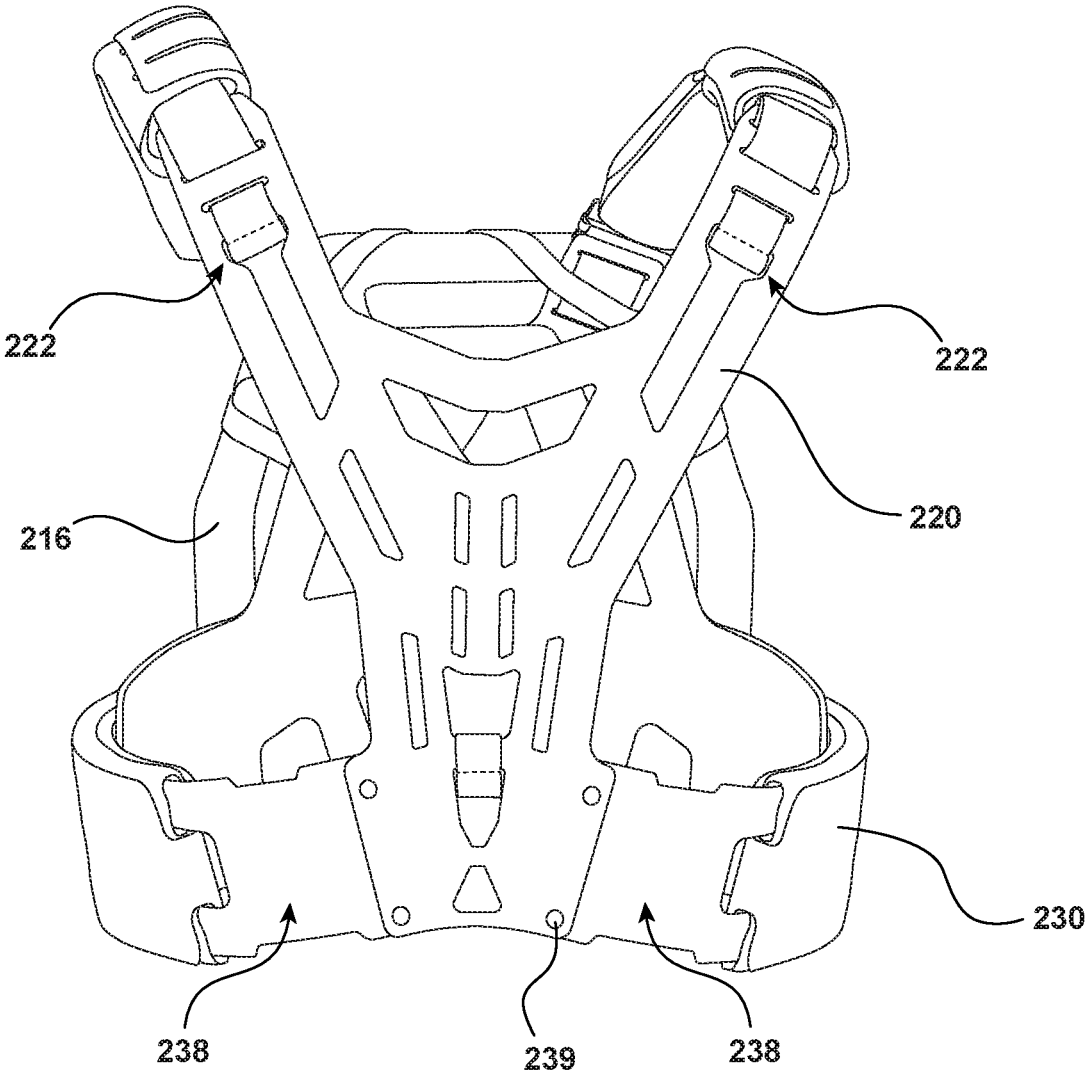
FIG. 12 is a rear view of a wearable load redistribution system as shown in FIG. 12, including features for securing a back plate assembly according to certain aspects of the present disclosure.
Figure 13:
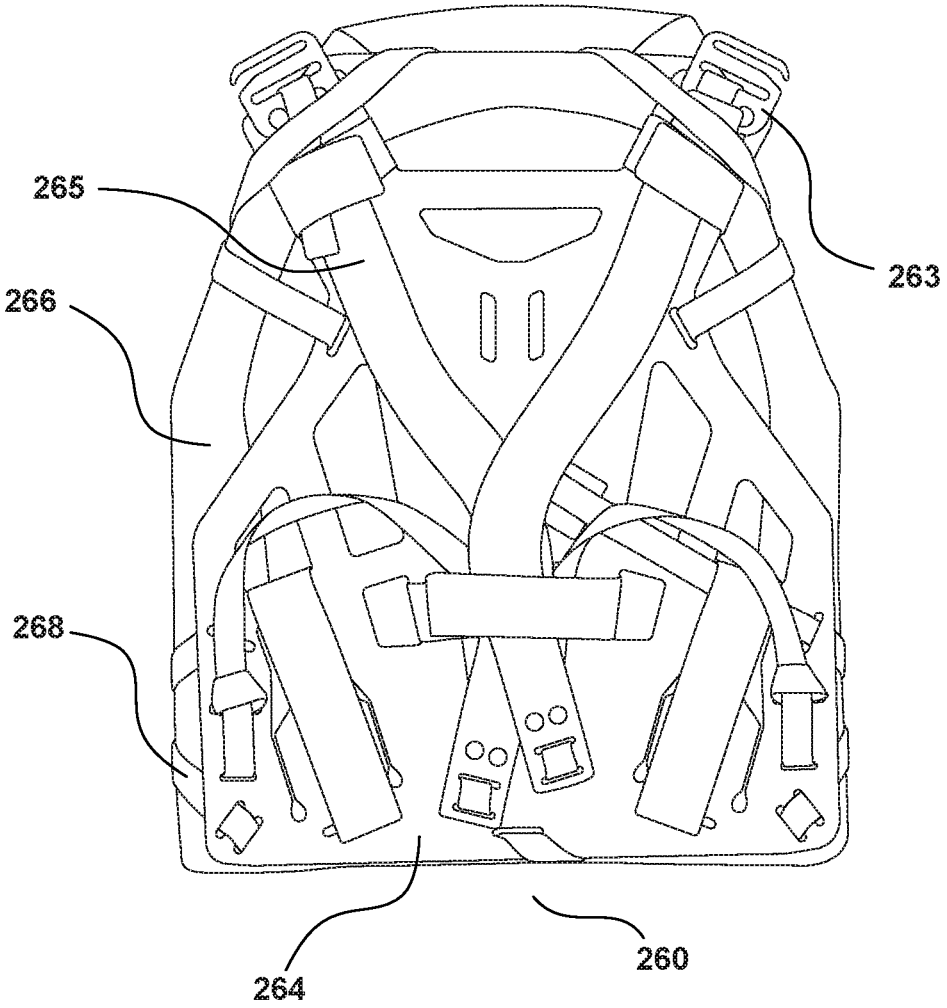
FIG. 13 shows a removable back plate assembly according to certain aspects of the present disclosure.

FIG. 12 is a rear view of the load carriage system 200 as shown in FIGS. 10 and 11. As can be seen in FIG. 12, the load carriage system 200 may include back harness panel 220, which in this case has an essentially "Y" shaped configuration, e.g. to assist in distributing a load of the load carriage system 200 to the user's shoulders. The cummerbund belt 236 (which in this case includes belt attachment feature 238) may be made of similar material, attached to, and/or integrally formed with, the back harness panel 220. In the example shown in FIG. 12, the back harness panel 220 is attached to the cummerbund belt 236 via attachment screws 239. However, unless otherwise indicated, such attachments may be formed by any means known in the art.

Figure 14:
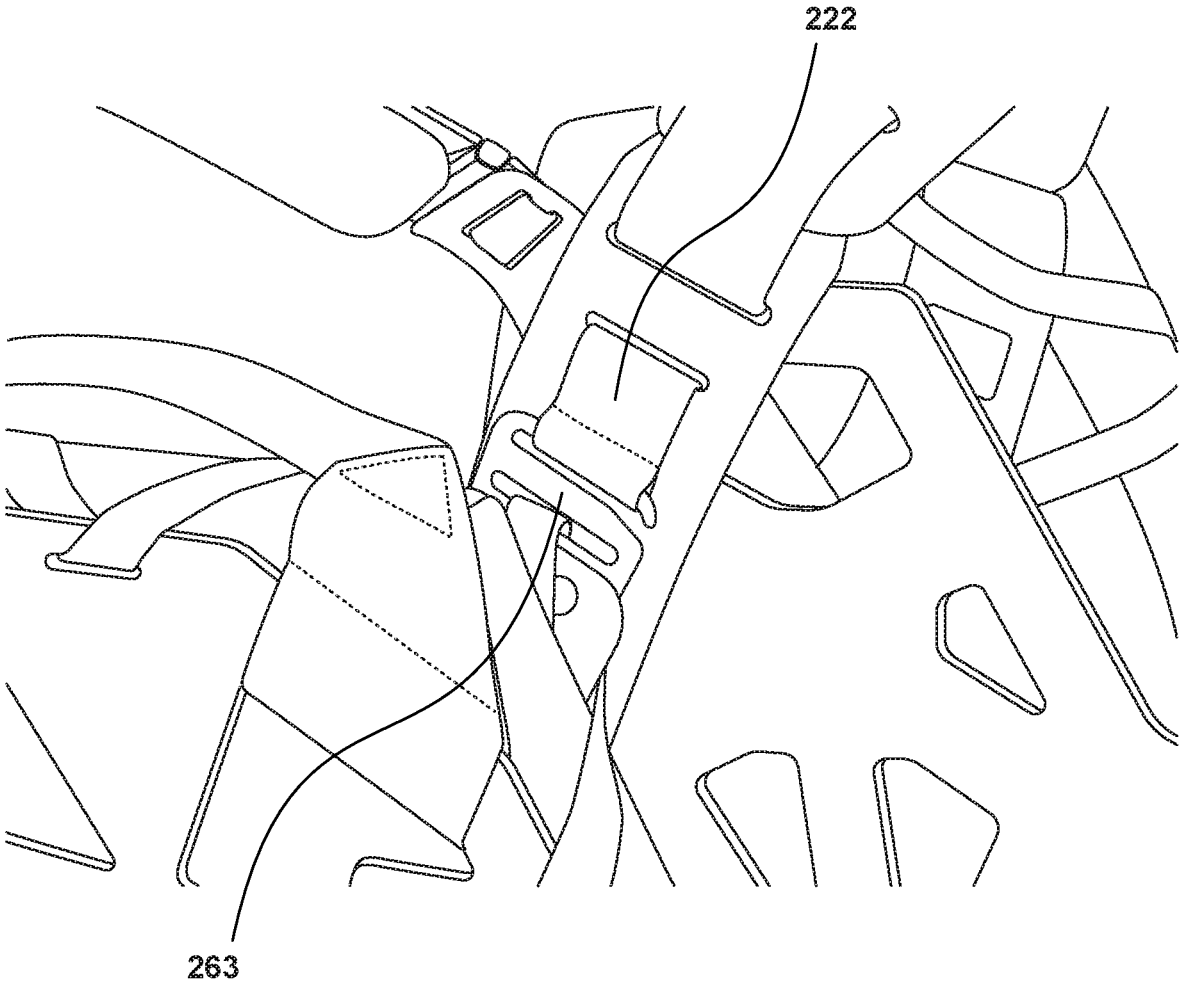
FIG. 14 shows details of an attachment mechanism for a removable back plate assembly according to certain aspects of the present disclosure.
Figure 15:
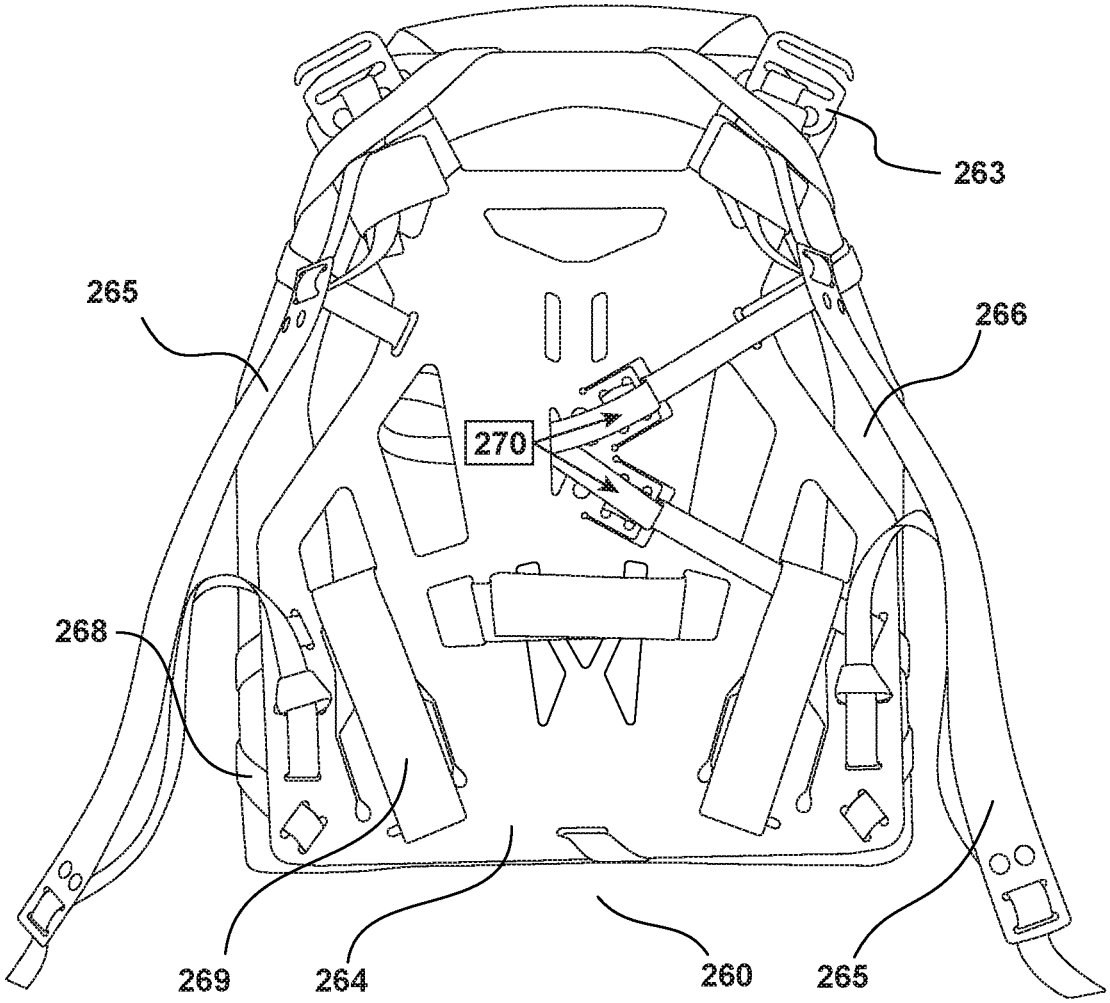
FIG. 15 shows additional details of a removable back plate assembly according to certain aspects of the present disclosure.

The back pack attachment features 222 may take various forms, such as hooks, loops, Velcro®, side release buckles, slot connectors, etc., and may be used to secure various pieces of equipment to the back harness panel 220. In the example shown in FIGS. 12 and 14, the back pack attachment features 222 are fixed loops of webbing material into which complementary hooks can be attached. For example, removable back plate assembly 260 (shown in FIGS. 13 and 15) may include a complementary pair of hook-shaped back pack attachment features 263 that attach to attachment features 222 (as shown in FIG. 14), and allow the removable back plate assembly 260 to be attached to, and removed from, load carriage system 200. Like the back plate assembly 120 discussed above, removable back plate assembly 260 may include an outer back panel, an inner back panel 264, and/or ballistic back plate 266. Likewise, the outer back panel may be attached to the inner back panel 264, and squeeze the ballistic back plate 266 therebetween, via one or more straps of webbing 268 that wind through openings in the outer back panel and the inner back panel 264.

The removable back plate assembly 260 may also include shoulder straps 265, which may be used to perform various functions. For example, the shoulder straps 265 may be integrated with the load carriage system 200 when the removable back plate assembly 260 is attached, e.g. running over, under or within shoulder straps 240. The shoulder straps 265 may also be configured for a user to easily don and doff the removable back plate assembly 260 without the use of separate attachment features, e.g. for emergency use.

The outer panels of front plate assembly 210 and/or removable back plate assembly 260 have built-in attachment features (e.g., holes therethrough, attachment mechanisms, etc.) that allow tactical equipment to be attached to the load carriage system 200, similar to methods and features described above.

As described above, the panels of front plate assembly 210 and/or removable back plate assembly 260 may also have unnecessary material removed, e.g. to decrease the weight that is loaded on the user. In such cases, the panels may include a continuous outer perimeter, with voids inside the perimeter that may equal, for example, 50% or more of the total surface area of the panel.

In some embodiments, the panels of front plate assembly 210 and/or removable back plate assembly 260 may generally correspond to the size, shape, and curvature of the ballistic plate. However, in embodiments that use a "cinching" mechanism, such as webbing straps 218, 268, the outer perimeters of the panels may be smaller than, or include portions that extend within, the outer perimeter of the corresponding ballistic plate. This can allow, for example, the load carriage system 200 to accommodate, and hold in a fixed position, ballistic plates of different sizes and/or shapes.

As discussed herein, the cummerbund element(s) 230 may be "self-adjusting," and include a tensioning mechanism configured to allow the cummerbund to extend and retract while being worn by the user, and during donning and removing the load carriage system 200.

The cummerbund element 230 may be releasably attached to the chest panel (and/or the back panel) via a quick release at buckle 232. A cooperating buckle 234 of the quick release mechanism is affixed to the outer chest panel 212 (and/or the outer back panel), and is configured to flex about the Z axis (i.e. in and out of the page of FIG. 10), and to resist rotation relative to the Z axis (i.e. up and down in FIG. 10). This may be accomplished, for example, by nesting the buckle 234 in a conforming portion (e.g. a "cutout") of the outer chest panel 212, which can inhibit rotation of the buckle 234 relative to the Z axis via cooperative engagement with the conforming portion.

In the embodiment shown in FIG. 11, the cummerbund element 230 is attached to back harness panel 220 via fasteners 239. These attachment points provide stability to the cummerbund element 230 and assist in distributing loads between the front plate assembly and the back harness panel, and about the torso. In this regard, the attachment of the cummerbund element 230 and back harness panel 220 is configured to flex about the Z axis (i.e. in and out of the page of FIG. 11) via flexion of the cummerbund material at the attachment, and to resist rotation relative to the Z axis (i.e. up and down in FIG. 11) via the two attachments at the top and bottom and the relative rigidity of the cummerbund material (and structure) in the vertical direction.

It should also be appreciated that, although the embodiment depicted in FIGS. 10 and 11 has the cummerbund element 230 attached to the outer chest panel 212, other embodiments may change this arrangement, e.g. to include similar attachments to the inner front panel 214, including embodiments which may not include inner or outer panels.

As with the examples described above, the panels of the front plate assembly 210 and/or back harness panel 220 may include, or be joined with, panel extensions, e.g. additional panel portions that may be constructed with similar materials and/or attachment features, and that increase the effective size of the panel. These may be attached to and/or formed in a lower portion of the panel, and may generally extend under the arms of the user in the vicinity of the cummerbund element(s) 230. For example, the inner chest panel 214 may include and/or be attached to chest panel extensions 215 (as shown in FIG. 10), and/or the back harness panel 220 may include and/or be attached to back panel extensions (similar to those shown in FIGS. 8 and 9).

In embodiments, various other tactical items may be secured to panel extensions and/or side armor in the vicinity of the cummerbund element 230. This may be accomplished, at least in some examples, by providing attachment features to the panel extensions and/or side armor, and due to the extendibility of the cummerbund element, which allows it to provide additional space (between the panel extensions and/or side armor) in which the additional items may be accommodated.

As shown in FIG. 12, attachment features 238 for securing a back plate or other assembly to the load carriage system 200 may be included in the back harness panel 220 and/or cummerbund element 230. In the embodiments shown in FIG. 12, the attachment features 238 are built in to (e.g. formed or patterned in) a portion 236 of the cummerbund. Specifically, attachment features 238 are narrowed portions of the cummerbund belt 236 in which an attachment mechanism of the back plate (such as Velcro® loops 269) or other assembly may be restrained from moving forward or backward (i.e. around) on the cummerbund element 230.

In some examples, the webbing straps 268 may be two pieces of webbing, e.g. with one webbing strap securing the upper portion of the back plate assembly 260, and another webbing strap securing the lower portion of the back plate assembly, as discussed above.

The inner panel 264 may also include securing straps and flat friction lock features according to certain aspects of the present disclosure. Each of webbing straps 268 may have a standing end that is fixed or otherwise attached to inner back panel 264, and a free end that is routed through slots in the outer back panel, and inner chest panel 264, and flat friction lock 270. The ballistic chest plate 266 may thereby be securely fastened in a fixed position between the outer chest panel and the inner chest panel 264. It should be further appreciated that, using this configuration, a variety of differently sized and/or shaped ballistic chest plates may be accommodated by the removable back plate assembly 260.

Figure 16:
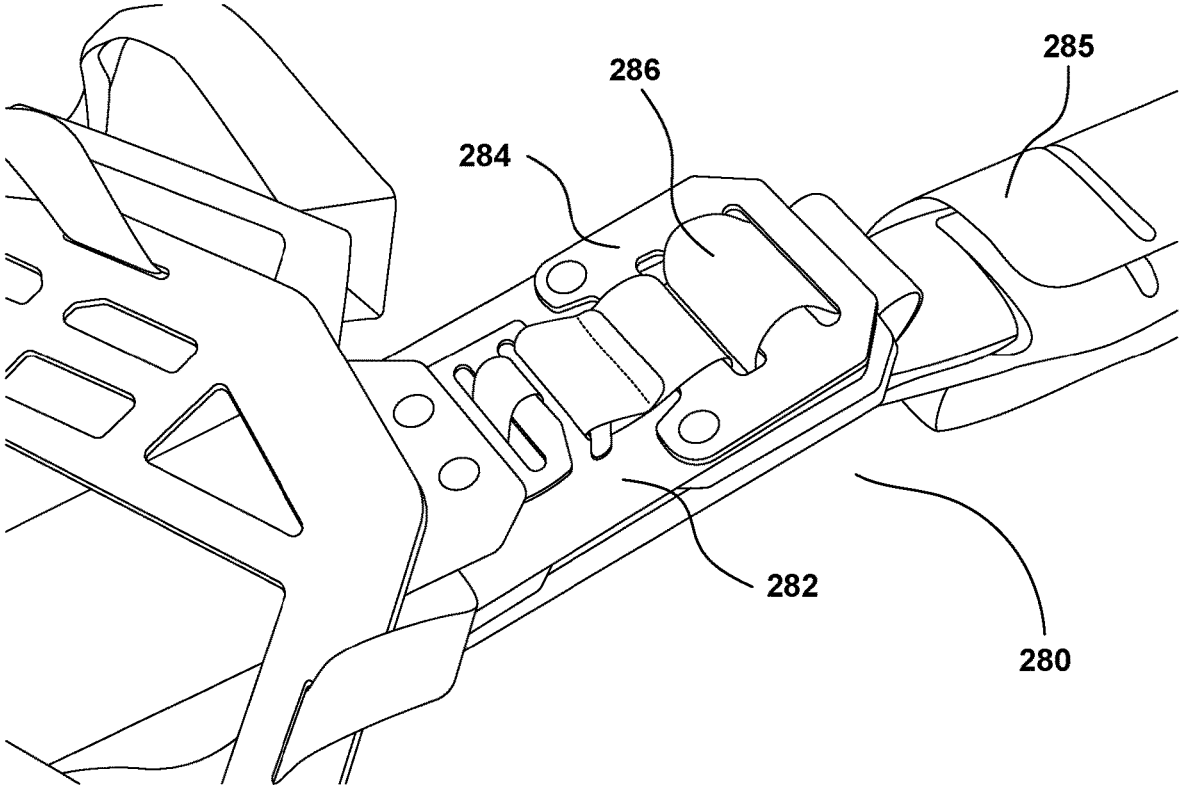
FIG. 16 shows an exemplary flat friction lock according to certain aspects of the present disclosure.

FIG. 16 shows another example of a flat friction lock 280, incorporated in a shoulder strap. The flat friction lock 280 may be used in various other embodiments described herein, e.g. as a means of securing shoulder, or other straps, belts, etc. As shown in FIG. 16, the flat friction lock 280 includes a portion 282 that may be formed with, or attached to, a panel, a panel extension, or a shoulder strap. A second portion 284 may be secured to, and partially overlap, the first portion 282. The second portion 284 may be made of a material that is more rigid than the first portion 282. For example, the second portion may be made of aluminum or other alloy, and the first portion may be made of a panel material as otherwise described herein. Each of the first portion 282 and second portion 284 have slots formed therein, whereby the strap of webbing 286 is fed through and secured when tension is applied to the strap 286. A free end of strap 286 may be secured in an outer sleeve of shoulder strap 285. The jaw formed by the slots in the first portion 282 and the second portion 284 may be released by withdrawing the free end of the strap 286 from the shoulder strap sleeve and pulling it up or back.

Although the embodiments shown in FIGS. 1-16 include features related to carrying one or more ballistic plates, it should be appreciated that various features described herein can also be applied to other load carrying equipment, such as ski patrol or rescue harnesses, weighted training vests, baby carriers, tactical (non-plate carrying) vests, etc. For example, instead of front plate assembly 210 and removable back plate assembly 220, a harness such as shown in FIG. 11 may be configured with a baby carrier attached to the front (or back), and/or include a removable backpack or other modular equipment. This is just one of many options that will be appreciated by those of skill in the art.

Figure 17:
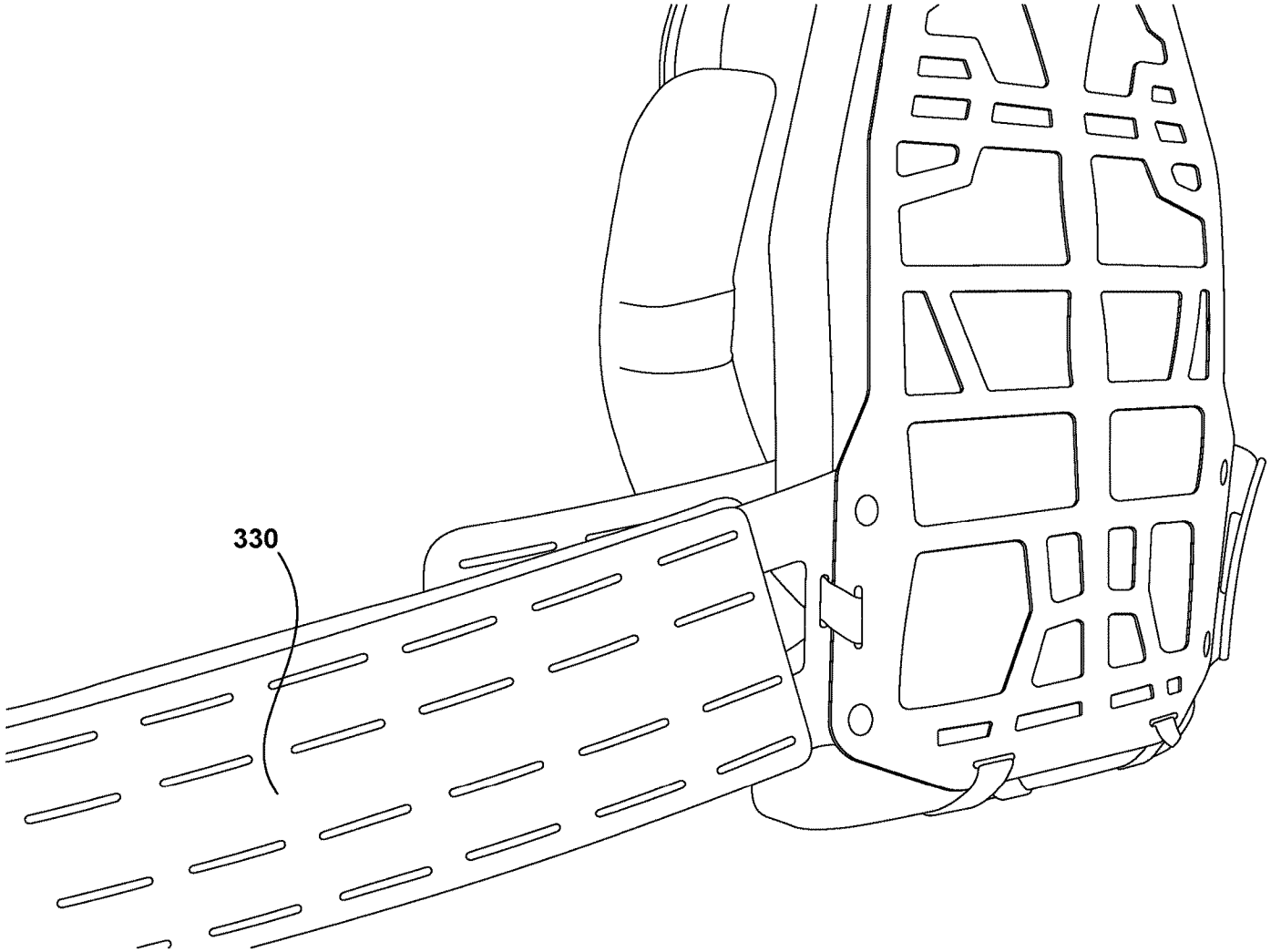
FIG. 17 shows an unextended cummerbund and outer panel according to certain aspects of the present disclosure.
Figure 18:
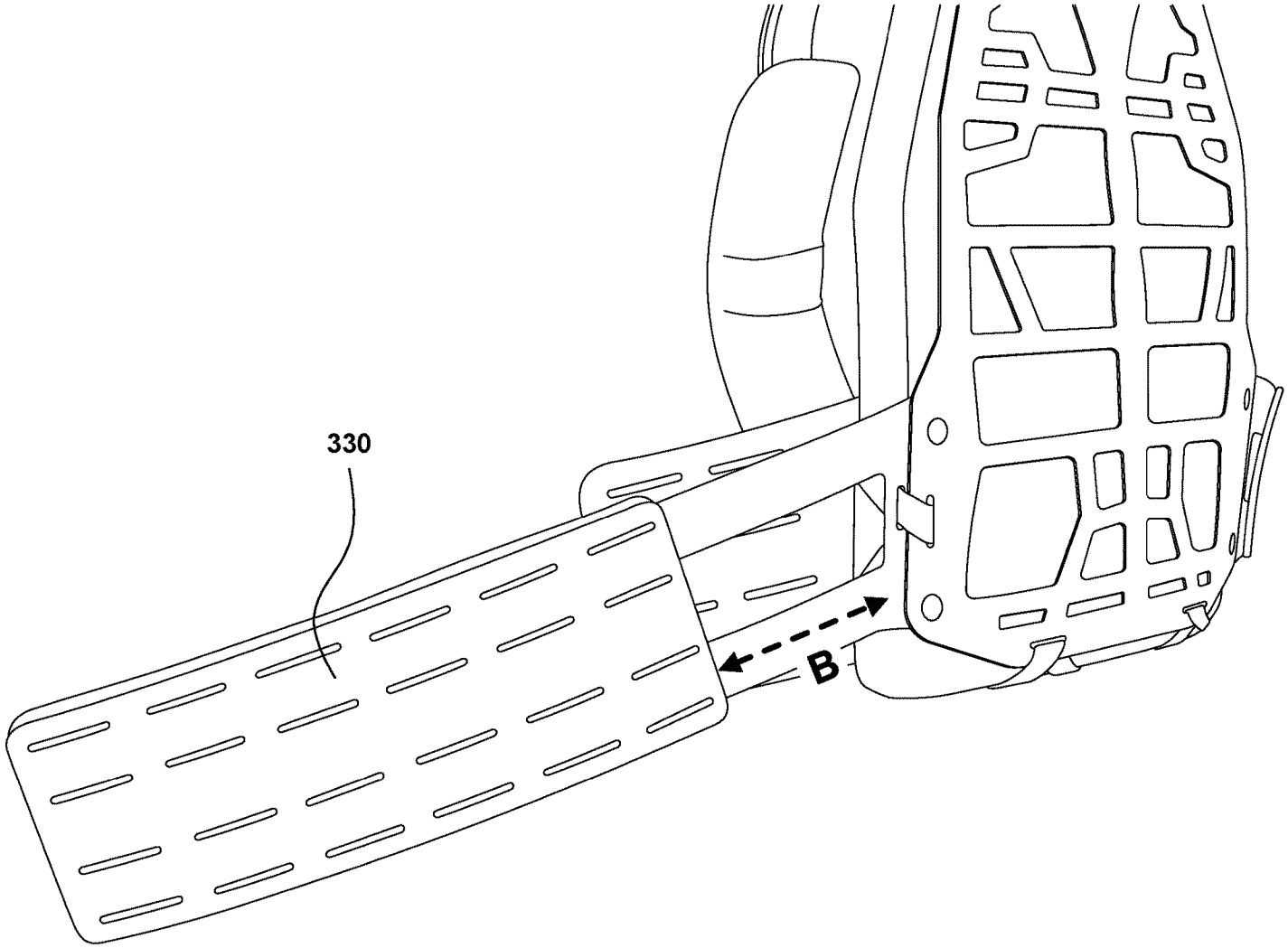
FIG. 18 shows an extended cummerbund and outer panel according to certain aspects of the present disclosure.

As mentioned previously, embodiments may further include cummerbunds that can extend, and retract via their own internal mechanisms. For example, a cummerbund assembly 330 may assume a non-extended position when no tension is applied (e.g. as shown in FIG. 17), extend to various lengths when tension is applied (e.g. as shown in FIG. 18), and resume the non-extended positions (or other intermediate positions) when the tension is reduced or removed (e.g. as shown in FIG. 17). The maximum extension of the cummerbund assembly 330 (e.g. along arrow "B" in FIG. 18) may vary depending on, for example, the lengths of the components used, as well as internal adjustment mechanisms. In some embodiments, the maximum extension may be, for example, greater than 2 inches, greater than 4 inches, and/or up to 8 inches. The non-extended length of the cummerbund element 330 may also be adjustable, as described further herein.

As will be appreciated looking at FIGS. 17 and 18, the cummerbund assembly 330 includes a portion that remains fixed to the back plate assembly, and another portion that moves relative to the portion fixed to the back plate assembly. This arrangement may be reversed or combined such that a portion of the cummerbund is fixed to a front assembly and another portion of the cummerbund moves relative to the front-fixed portion.

Figure 19:
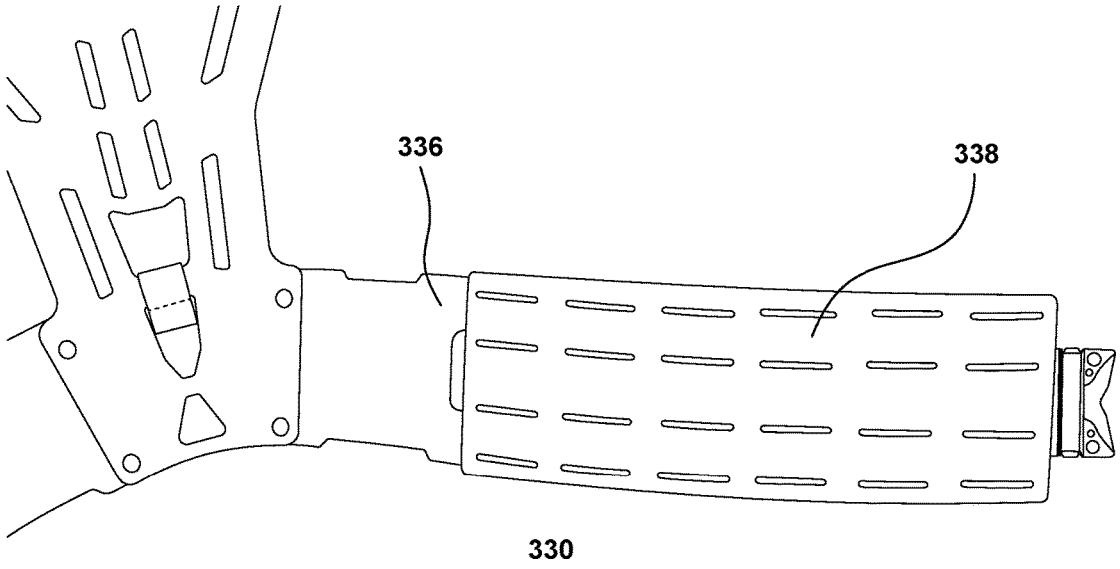
FIGS. 19 and 20 show details of an extendible cummerbund assembly according to certain aspects of the present disclosure.
Figure 20:
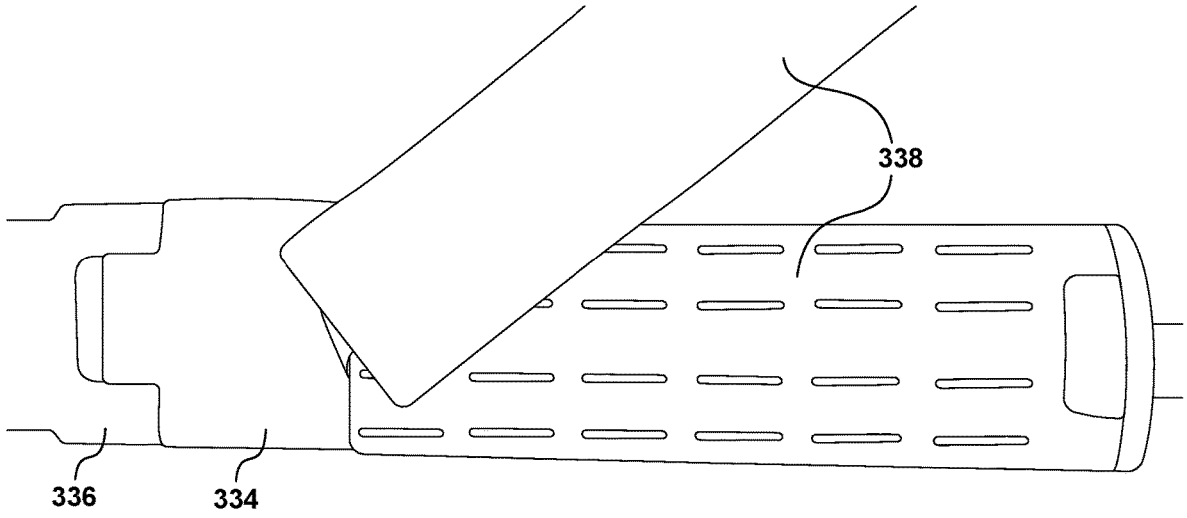

FIGS. 19 and 20 show details of an extendible cummerbund assembly 330 according to certain aspects of the present disclosure. As shown in FIG. 19, a cummerbund assembly 330 may include a sliding portion 336, and an outer sleeve 338. As used herein, a sliding portion of the cummerbund element and/or assembly may be understood as a portion of the cummerbund that moves relative to some other portion of the cummerbund. As described further below, the sliding portion 336 may move relative to the outer sleeve 338, as well as other parts of the cummerbund assembly 330.

As shown in FIG. 20, the cummerbund assembly 330 may include outer sleeve 338, which may be run though a slot in sliding portion 336. Housed within outer sleeve 338 is a length of material 334, which also may be run through the slot in sliding portion 336.

In embodiments, the length of material 334 may be made from HDPE, PP thermoplastic tape yarn sheeting (Tegris®), injection molded sheet material, Boltaron, PVC, PVC/acrylic alloy, and CPVC, thermoformed sheet material, extruded polymer sheets, and/or hybrid or laminated combinations thereof.

Figure 21:
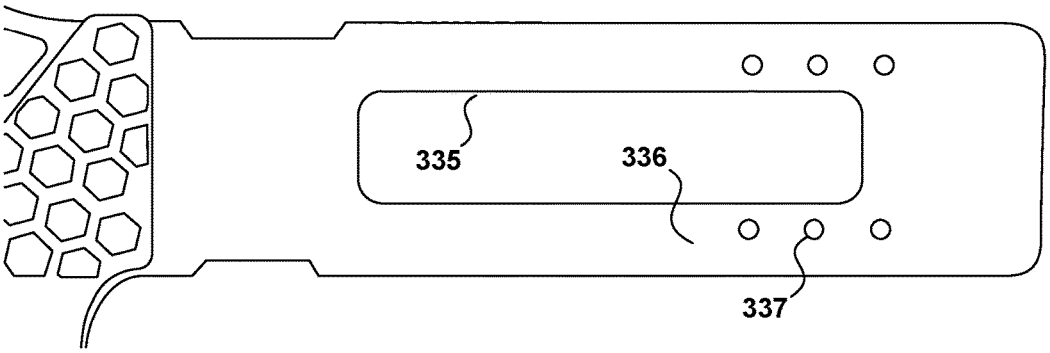
FIGS. 21 and 22 show additional details of components of an extendible cummerbund assembly according to certain aspects of the present disclosure.
Figure 22:
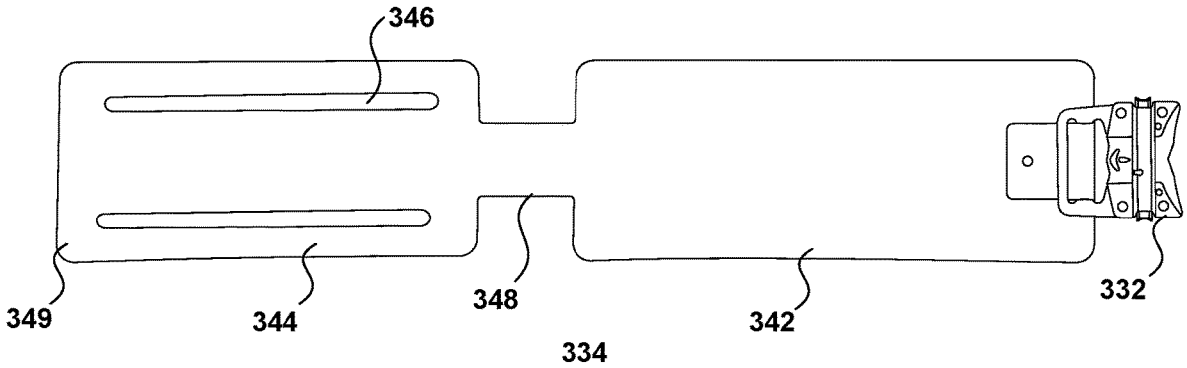

FIGS. 21 and 22 show additional details of components of extendible cummerbund assembly 330. FIG. 21 shows an exemplary sliding portion 336 including a slot 335 (through which the length of material 334 and/or outer sleeve 338 may be fed through) and a plurality of adjustment points 337 (through which an elastic member or other adjusting element may be fed though). The sliding portion 336 may be made, for example, of a panel material as described herein, such as from HDPE, PP thermoplastic tape yarn sheeting (Tegris®), injection molded sheet material, Boltaron, PVC, PVC/acrylic alloy, and CPVC, thermoformed sheet material, extruded polymer sheets, and/or hybrid or laminated combinations thereof.

FIG. 22 shows a length of material 334 including a first portion 342 attached to a buckle 332, which may be configured to attached to a front or back panel as discussed herein. The length of material 334 may also include a second portion 344 connected to the first portion 342 by a narrowed part 348. The second portion 344 may include one or more tracks 346, which may be used to accommodate an elastic member or other extending mechanism. The length of material 334 may also include a free end 349, which may include built-in attachment features for securing an elastic member thereto.

Figure 23:
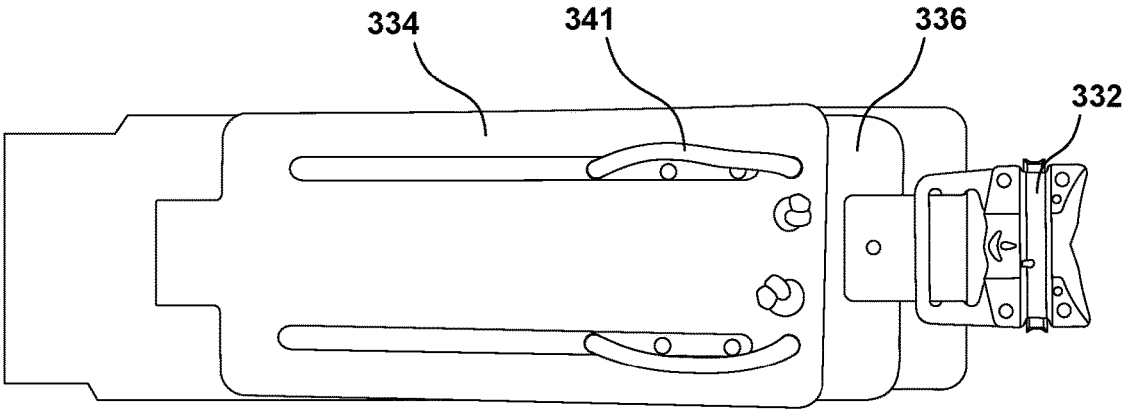
FIGS. 23 and 24 show additional details of components of an extendible cummerbund assembly according to certain aspects of the present disclosure.

FIG. 23 shows a partial configuration of cummerbund assembly 330 with length of material 334 fed though and folded over sliding portion 336, as well as at least partially folded over itself. An elastic part 341 may be attached to a free end of the length of material 334 and the sliding portion 336. An unextended and/or extended length of the cummerbund assembly 330 may be adjusted, for example, by changing the holes 337 through which the elastic part 341 is fed through, changing a length of elastic part 341, etc. In some embodiments, the maximum extension provided by the elastic part may be, for example, greater than 2 inches, greater than 4 inches, and/or up to 8 inches.

Figure 24:
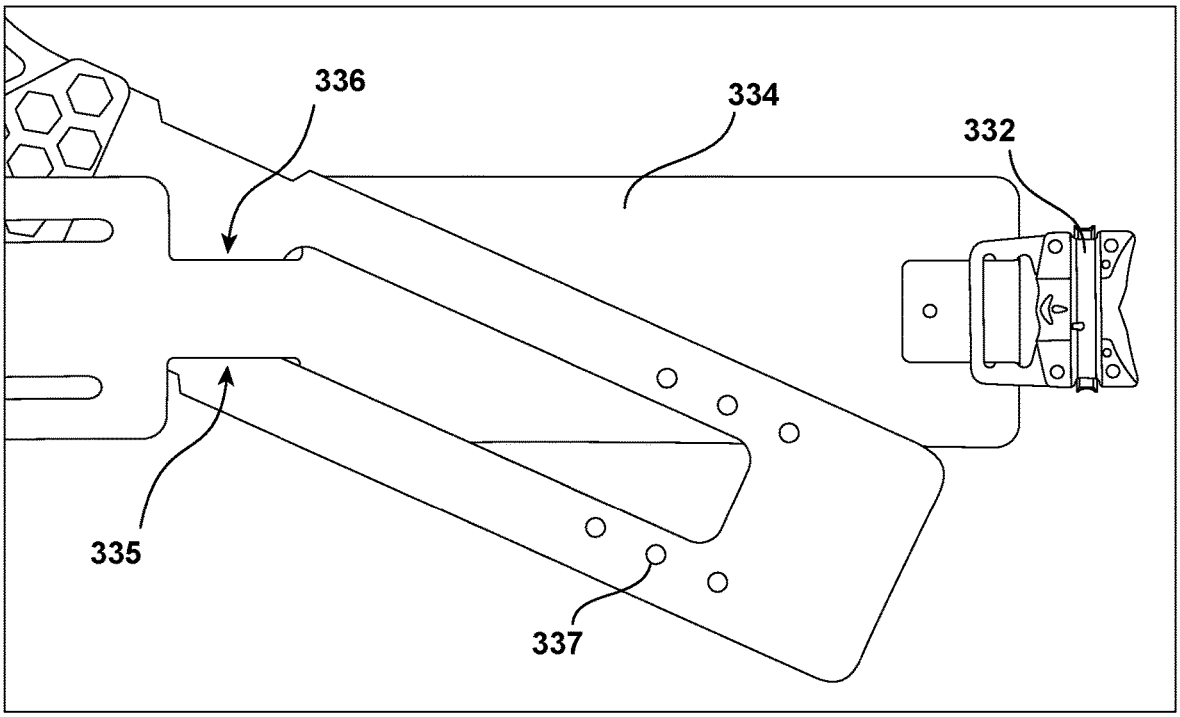

FIG. 24 shows the assembly of FIG. 23 partially disassembled and unfolded. As shown in FIG. 24, the length of material 334 can be fed though and folded over sliding portion 336 with the narrowed portion 348 accommodated in the slot 335. Thus, the length of material 334 and the sliding portion 336 can move relative to each other, thereby allowing extension of the cummerbund assembly 330.

In embodiments, a tensioning mechanism of the cummerbund element 330 may be configured to provide varying resistive force. For example, the tensioning mechanism may be configured to provide a first resistive force when flat, and a second resistive force when curved, the second resistive force being greater than the first resistive force. Such variation may be provided, for example, based on an increase in the friction between the length of material 334 and the sliding portion 336 when the cummerbund element 330 is wrapped around a user's torso or otherwise curved. This friction may be reduced when the cummerbund element 330 is laid flat or otherwise straightened out. Such variation may be beneficial, for example, in allowing a user to easily extend the cummerbund when donning the harness, and then providing increased resistance while being worn, which can improve the comfort and/or load distribution of the harness.

In embodiments, the tensioning mechanism may be configured to allow the harness to expand, via extension of the cummerbund, as the user moves, while maintaining a constrictive pressure on the user, e.g. via a tension applied by elastic member 341 or similar mechanism.

Figure 25:
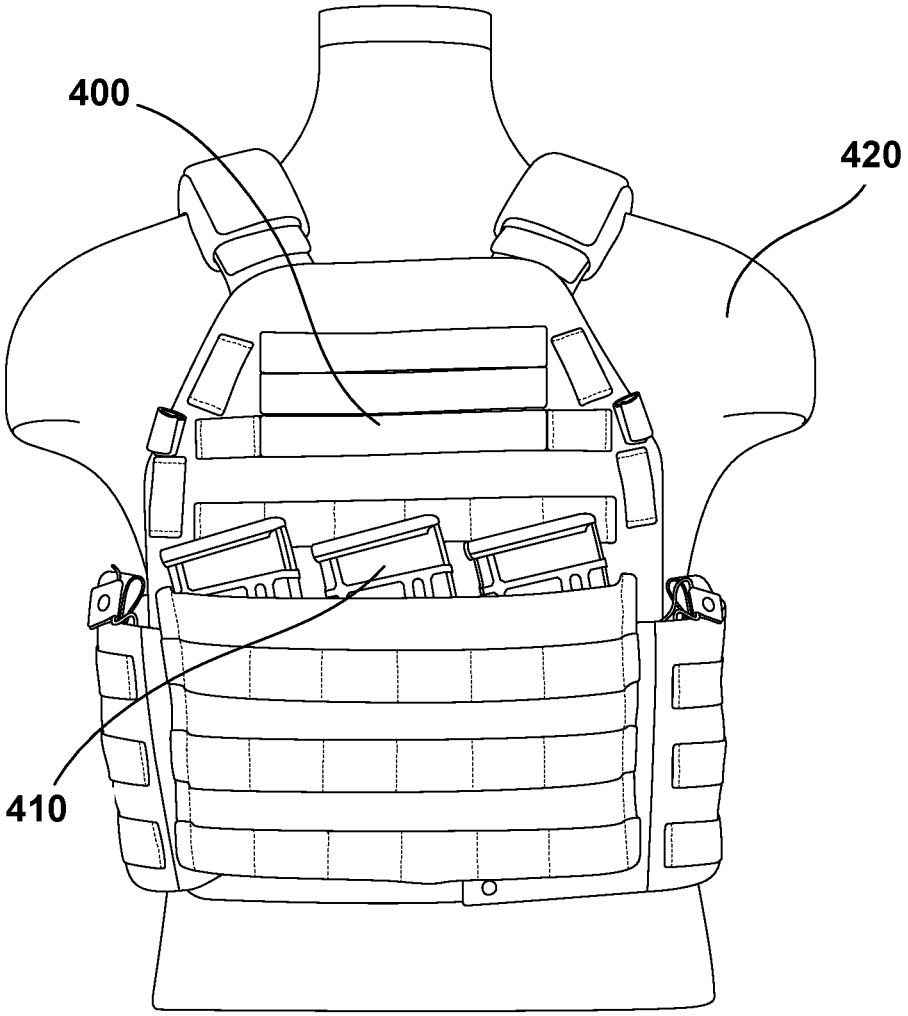
FIG. 25 shows an exemplary chest harness mounted on a torso.

FIG. 25 shows a front view of an exemplary system 1100 (which may include various features described herein) as worn by a user (e.g. torso 420), including a load carriage harness 400 and three magazine retention devices (MRDs) 410 holding individual firearm magazines contained in a "kangaroo pouch." As mentioned previously, hook and/or loop fabric, or other attachment mechanisms, may be included on or attached to the exterior surface(s) of the MRD 410 or other accessory holder to easily secure the holder in a pouch or other carrier with complimentary attachment fabric/mechanisms. In embodiments, webbing, attachment straps, pouches, etc., be made of a polyvinyl chloride ("PVC") coated nylon, a vinyl-coated polyester or cordura or ripstop fabric, a two-way or four-way stretch nylon and Spandex blend, and/or a polyester mesh. These materials are merely example materials and not limiting of the materials from which these components may be made, and can be a non-porous, liquid and/or chemical resistant fabric.

Embodiments disclosed herein provide a plate frame or other torso harnesses which hold body armor and/or any other loads, in a manner more streamlined and/or comfortable than prior art vests. The load bearing harness is also capable of holding accessory pouches and providing access to accessory pouches and other attachments to the harness.

Any feature of any embodiment discussed herein may be combined with any feature of any other embodiment discussed herein in some examples of implementation.

Certain additional elements that may be needed for operation of certain embodiments have not been described or illustrated as they are assumed to be within the purview of those of ordinary skill in the art. Moreover, certain embodiments may be free of, may lack and/or may function without any element that is not specifically disclosed herein.

Although various embodiments and examples have been presented, this was for the purpose of describing, but not limiting, the invention. Various modifications and enhancements will become apparent to those of ordinary skill in the art and are within the scope of the invention, which is defined by the appended claims.

What is claimed:

1. A ballistic plate carrier, comprising:

an outer chest panel made of a rigid material that naturally returns to an original shape of the outer chest panel after deformation under operational loads;

an inner chest panel;

an inner back panel;

an outer back panel made of a rigid material that naturally returns to an original shape of the outer back panel after deformation under operational loads; and a cummerbund connecting the outer chest panel and the outer back panel, wherein, the outer chest panel and the inner chest panel are configured to hold a ballistic chest plate therebetween, and the outer back panel and the inner back panel are configured to hold a ballistic back plate therebetween.

2. The plate carrier of claim 1, wherein the ballistic chest plate is held in place by one or more webbing straps wound through the outer chest panel and the inner chest panel, and the ballistic back plate is held in place by one or more webbing straps wound through the outer back panel and the inner back panel.

3. The plate carrier of claim 2, wherein at least one of the webbing straps is (a) secured to the inner chest panel or inner back panel via a flat slip fitting that is formed at least partially of the inner chest panel or inner back panel, and is (b) adjustable via the flat slip fitting.

4. The plate carrier of claim 1, wherein the outer chest panel and inner chest panel, and the outer back panel and inner back panel, are configured to allow the plate carrier to accommodate, and hold in a fixed position, ballistic plates of at least one of different sizes or different shapes.

5. The plate carrier of claim 1, wherein at least one of the outer chest panel and the outer back panel includes a cummerbund attachment mechanism with a Z axis that is vertically aligned with the plate carrier, and the cummerbund attachment mechanism is configured to flex about the Z axis, and to resist rotation relative to the Z axis.

6. The plate carrier of claim 1, wherein at least one of the inner chest panel and the inner back panel includes a waist extension that extends beyond a footprint of the respective ballistic chest plate or ballistic back plate, and that is overlapped by the cummerbund when the plate carrier is worn.

7. The plate carrier of claim 6, wherein the waist extension includes built-in attachment features for securing tactical gear to the waist extension.

8. The plate carrier of claim 1, wherein at least one of the outer chest panel and the outer back panel includes a plurality of built-in attachment features configured to mount tactical equipment thereto.

9. The plate carrier of claim 1, wherein the outer chest panel, the inner chest panel, the outer back panel, and the inner back panel are made of a material that is elastic when bent, but substantially inelastic in at least one of tension or compression.

10. The plate carrier of claim 1, wherein the outer chest panel, the inner chest panel, the outer back panel, and the inner back panel are made of at least one of HDPE, PP thermoplastic tape yarn sheeting, injection molded sheet material, PVC, PVC/acrylic alloy, and CPVC, thermoformed sheet material, extruded polymer sheets, hybrid combinations thereof, or laminated combinations thereof.

11. The plate carrier of claim 1, wherein the cummerbund includes a tensioning mechanism comprising a sliding portion, a continuous patterned length of material that is folded over itself, and an elastic member that is attached to the sliding portion and the length of material.

12. The plate carrier of claim 11, wherein the length of material is made from at least one of HDPE, PP thermoplastic tape yarn sheeting, injection molded sheet material, PVC, PVC/acrylic alloy, and CPVC, thermoformed sheet material, extruded polymer sheets, hybrid combinations thereof, or laminated combinations thereof.

13. The plate carrier of claim 11, wherein at least parts of the sliding portion and the length of material are at least partially housed within an outer cummerbund belt.

14. The plate carrier of claim 1, further comprising a webbing buckle, comprising:

a first portion that is integrally formed with at least one of a load bearing strap, the inner chest panel, or the inner back panel; and a second portion that is made of a rigid material and that at least partially overlaps the first portion, wherein the buckle is configured to (a) seize a piece of webbing in a jaw formed by the first portion and the second portion when the piece of webbing is woven through the first portion and the second portion and the piece of webbing is put under tension in a first direction, and to (b) release the piece of webbing when the tension in the first direction is removed and tension is applied to the piece of webbing in a second direction that is 90° to 180° off of the first direction.

15. The plate carrier of claim 14, wherein the at least one of a load bearing strap, the inner chest panel, or the inner back panel are made from a panel of material and the first portion is a patterned portion of the panel of material.

16. The plate carrier of claim 15, wherein the panel of material made from at least one of HDPE, PP thermoplastic tape yarn sheeting, injection molded sheet material, PVC, PVC/acrylic alloy, and CPVC, thermoformed sheet material, extruded polymer sheets, or hybrid or laminated combinations thereof.

17. The plate carrier of claim 14, wherein the buckle is configured to release the piece of webbing when the substantially opposite tension is applied to the piece of webbing via the first portion lifting away from the second portion.

18. The plate carrier of claim 14, wherein the first portion is made of a material that is elastic when bent, but substantially inelastic in at least one of tension or compression, and the second portion is made from an inflexible material.

19. A ballistic plate carrier, comprising:

an outer chest panel;

an inner chest panel;

an inner back panel;

an outer back panel; and a cummerbund connecting the outer chest panel and the outer back panel, wherein, the outer chest panel and the inner chest panel are configured to hold a ballistic chest plate therebetween, the outer back panel and the inner back panel are configured to hold a ballistic back plate therebetween, and the plate carrier is configured to hold the ballistic chest plate in place by one or more webbing straps wound through the outer chest panel and the inner chest panel, and to hold the ballistic back plate in place by one or more webbing straps wound through the outer back panel and the inner back panel.

20. The ballistic plate carrier of claim 19, wherein the outer back panel and the inner back panel are configured to be removable from the plate carrier by a user, such that the outer chest panel and the inner chest panel may be worn by the user with the ballistic chest plate independently of the outer back panel and the inner back panel.

* * * * *